US005660963A

United States Patent [19]

Doujo et al.

[11] Patent Number: 5,660,963

[45] Date of Patent: Aug. 26, 1997

[54] TONER FOR DEVELOPING ELECTROSTATIC IMAGE

[75] Inventors: Tadashi Doujo, Kawasaki; Takaaki Kohtaki, Yokohama; Makoto Unno, Tokyo; Yushi Mikuriya, Kawasaki, all of Japan

[73] Assignee: Canon Kabushiki Kaisha, Tokyo, Japan

[21] Appl. No.: 563,290

[22] Filed: Nov. 28, 1995

[30] Foreign Application Priority Data

| | | | |
|---|---|---|---|
| Nov. 28, 1994 | [JP] | Japan | 6-316073 |
| Dec. 28, 1994 | [JP] | Japan | 6-337704 |

[51] Int. Cl.[6] ..... G03G 9/087

[52] U.S. Cl. ..... 430/107; 430/106.6; 430/109

[58] Field of Search ..... 430/107, 106, 430/106.6, 104

[56] References Cited

U.S. PATENT DOCUMENTS

| | | | |
|---|---|---|---|
| 2,297,691 | 10/1942 | Carlson | 95/5 |
| 2,781,419 | 2/1957 | Ragmi | 179/171 |
| 2,787,626 | 4/1957 | Redman | 260/448 |
| 2,835,689 | 5/1958 | Ziegler et al. | 260/448 |
| 2,892,858 | 6/1959 | Ziegler | 260/448 |
| 3,666,363 | 5/1972 | Tanaka et al. | 355/17 |
| 4,071,361 | 1/1978 | Marushima | 96/104 |
| 4,883,736 | 11/1989 | Hoffend et al. | 430/110 |
| 4,960,664 | 10/1990 | Yamada et al. | 430/109 |
| 5,234,787 | 8/1993 | Morimoto et al. | 430/109 |
| 5,250,382 | 10/1993 | Shimojo et al. | 430/109 |
| 5,312,704 | 5/1994 | Fuller et al. | 430/109 |
| 5,346,792 | 9/1994 | Kobayashi et al. | 430/109 |
| 5,395,726 | 3/1995 | Tavernier et al. | 430/109 |

FOREIGN PATENT DOCUMENTS

| | | | |
|---|---|---|---|
| 0606873 | 7/1994 | European Pat. Off. | G03G 9/087 |
| 3518414 | 1/1986 | Germany | G03G 9/08 |
| 3808448 | 9/1988 | Germany | G03G 9/08 |
| 56-87051 | 7/1981 | Japan | G03G 9/08 |
| 59-129863 | 7/1984 | Japan | G03G 9/08 |
| 62-78569 | 4/1987 | Japan | G03G 9/08 |
| 63-225246 | 9/1988 | Japan | G03G 9/08 |
| 63-225244 | 9/1988 | Japan | G03G 9/08 |
| 63-225245 | 9/1988 | Japan | G03G 9/08 |
| 2-129653 | 5/1990 | Japan | G03G 9/087 |
| 2-173038 | 7/1990 | Japan | G03G 63/20 |
| 3-46668 | 2/1991 | Japan | G03G 9/087 |
| 3-50561 | 3/1991 | Japan | G03G 9/08 |
| 4-97162 | 3/1992 | Japan | G03G 9/087 |
| 4-204543 | 7/1992 | Japan | G03G 9/083 |
| 808055 | 1/1959 | United Kingdom . | |

*Primary Examiner*—John Goodrow

*Attorney, Agent, or Firm*—Fitzpatrick, Cella, Harper & Scinto

[57] ABSTRACT

A toner for developing an electrostatic image is constituted by a resin composition and a colorant. The resin composition includes a high-softening point polyester resin (I) having a softening point of 120°–180° C. a low-softening point polyester resin (II) having a softening point of 80°–120° C., and a long-chain alkyl compound selected from the group consisting of-a long-chain alkyl alcohol principally comprising long-chain alkyl alcohol components having long-chain alkyl groups of 23 to 252 carbon atoms and a long-chain alkyl carboxylic acid principally comprising long-chain alkyl carboxylic acid components having long-chain alkyl groups of 22 to 251 carbon atoms. The resin composition preferably includes a tetrahydrofuran (THF)-soluble content providing a gel permeation chromatogram showing a weight-average molecular weight (Mw) of at least $10^5$, a ratio of Mw to number-average molecular weight (Mn) of at least 35 and an areal percentage of at least 5% of a region of molecular weight of at least $2\times10^5$.

50 Claims, 5 Drawing Sheets

TONER FOR DEVELOPING ELECTROSTATIC IMAGE

FIELD OF THE INVENTION AND RELATED ART

The present invention relates to a toner for developing electrostatic images used in image forming methods, such as electrophotography, electrostatic recording or electrostatic printing.

Hitherto, a large number of electro-photographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., as desired, fixed by heating, pressing, or heating and pressing, or with solvent vapor to obtain a copy or print carrying a fixed toner image.

As for the step of fixing the toner image onto a sheet material such as paper which is the final step in the above process, various methods and apparatus have been developed, of which the most popular one is a heating and pressing fixation system using hot rollers.

In the heating and pressing system, a sheet carrying a toner image to be fixed (hereinafter called "fixation sheet") is passed through hot rollers, while a surface of a hot roller having a releasability with the toner is caused to contact the toner-image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation.

It is however a current state that different toners are used for different models of copying machines and printers. This is primarily because the different models adopt different fixing speeds and fixing temperatures. More specifically, in the fixing step, a hot roller surface and a toner image contact each other in a melted state and under a pressure, so that a part of the toner is transferred and attached to the fixing roller surface and then re-transferred to a subsequent fixation sheet to soil the fixation sheet. This is called an offset phenomenon and is remarkably affected by the fixing speed and temperature. Generally, the fixing roller surface temperature is set to be low in case of a slow fixing speed and set to be high in case of a fast fixing speed. This is because a constant heat quantity is supplied to the toner image for fixation thereof regardless of a difference in fixing speed.

However, the toner on a fixation sheet is deposited in several layers, so that there is liable to occur a large temperature difference between a toner layer contacting the heating roller and a lowermost toner layer particularly in a hot-fixation system using a high heating roller temperature. As a result, a topmost toner layer is liable to cause an offset phenomenon in case of a high heating roller temperature, while a low-temperature offset is liable to occur because of insufficient melting of the lowermost toner layer in case of a low heating roller temperature.

In order to solve the above problem, it has been generally practiced to increase the fixing pressure in case of a fast fixing speed in order to promote the anchoring of the toner onto the fixation sheet. According to this method, the heating roller temperature can be somewhat lowered and it is possible to obviate a high-temperature offset phenomenon of an uppermost toner layer. However, as a very high shearing force is applied to the toner layer, there are liable to be caused several difficulties, such as a winding offset that the fixation sheet winds about the fixing roller, the appearance of a trace in the fixed image of a separating member for separating the fixation sheet from the fixing roller, and inferior copied images such as resolution failure of line images and toner scattering due to a high pressure.

Accordingly, in a high-speed fixing system, a toner having a lower melt viscosity is generally used than in the case of low speed fixation, so as to lower the heating roller temperature and fixing pressure, thereby effecting the fixation while obviating the high-temperature offset and winding offset. However, in the case of using such a toner having a low melt viscosity in low speed fixation, an offset phenomenon is liable to be caused because of the low viscosity.

Various toners have been proposed in order to satisfy both fixability at low temperatures and anti-offset characteristic at high temperatures. For example, Japanese Laid-Open Patent Applications (JP-A) 63-225244, 63-225245 and 63-225246 have disclosed a toner containing two types of non-linear polyester in order to provide improved low-temperature fixability, high-temperature anti-offset characteristic and anti-blocking characteristic. However, such a toner showing broad fixable temperature ranges and excellent anti-offset characteristic applicable to wide ranges from low process speed to high process speed still leaves room for improvement also in combination with image characteristics described below.

In recent years, there have been also desired high-quality copy or print images in accordance with the use of digitalized copying machines and fine toner particles. More specifically, it has been desired to obtain a photographic image accompanied with characters, so that the character images are clear while the photographic image is excellent in density gradation faithful to the original. Generally, in a copy of a photographic image accompanied with characters, if the line density is increased so as to provide clear character images, not only the density gradation characteristic of the photograph image is impaired, but also the halftone part thereof are roughened.

Further, resolution failure (collapsion) of line images and scattering are liable to be caused at the time of fixation as described above, so that the image qualities of the resultant copy images are rather liable to be deteriorated.

Further, in case where the line image density is increased, because of an increased toner coverage, a thick toner image is pushed against a photosensitive member to be attached to the photosensitive member in the toner transfer step, so that a so-called transfer failure (or a hollow image), i.e., a partial lack toner image (line images in this case), in the transferred image, is liable to be caused, thereby providing poor quality of copy images. On the other hand, in case where the gradation characteristic of a photographic image is intended to be improved the density of characters or line images are liable to be lowered, thus providing unclear images.

In recent years, there has been obtained some improvement in density gradation characteristic by a system including image density readout and digital conversion. However, a further improvement has been desired.

Regarding density gradation characteristic, it is impossible to obtain a linear relationship between a developing potential (difference between a photosensitive member potential and a developer-carrying member potential) and a resultant (copy) image density. More specifically, as shown in FIG. 1, a characteristic curve (e.g., a solid curve representing a case of providing a maximum intensity of 1.4) becomes downwardly convex at a low developing potential and upwardly convex at a high developing potential. Accordingly, in a halftone region, a slight change in developing potential leads to a remarkable change in image density. This provides a complexity in obtaining a satisfactory density gradation characteristic.

Generally, copied images appear clearer because of an edge effect so that clear line images can be retained in case where a maximum density of ca. 1.30 is attained at a solid image part which is less affected by the edge effect.

In case of a photographic image, however, the maximum density of a photograph appears less at a glance because of its surface gloss but actually amounts to a very high level of 1.90–2.00. Accordingly, in a copy of a photographic image, even if the surface gloss is suppressed, a solid part image density of ca. 1.4–1.5 is required since a density increase due to the edge effect cannot be excepted because of a large image area.

Accordingly, in providing a copy of a photographic image accompanied with characters, it becomes very important to obtain a developing potential-image density relationship which is close to the first order (linear) one and also a maximum image density of 1.4–1.5.

Further, the density gradation characteristic is liable to be remarkably affected by the saturation charge and the charging speed of a developer used. In case where the saturation charge is appropriate for the developing conditions, a developer showing a slow charging speed provides a low maximum image density, thus generally thin and blurred images in the initial stage of copying. In this case, however, non-problematic images can be obtained if the maximum image density is ca. 1.3, as described above, thus being able to obviate an adverse effect of the slow chargeability. Even in case of the slow charging speed, the initial copy image density is increased if the saturation charge is increased. However, on continuation of copying, the charge of the developer is gradually increased to finally exceed an appropriate charge for development, thereby resulting in a lower copy image density. Also in this case, no problem occurs in line images if the maximum image density is ca. 1.3.

From the above, it is understood that a photographic image is more remarkably affected by the saturation charge and the charging speed of a developer than a line image.

The use of a smaller particle size toner can increase the resolution and clearness of an image but is also liable to be accompanied with various difficulties.

First, a smaller particle size toner is liable to impair the fixability of a halftone image. This is particularly noticeable in high-speed fixation. This is because the toner coverage in a halftone part is small and a portion of toner transferred to a concavity of a fixation sheet receives only a small quantity of heat and the pressure applied thereto is also suppressed because of the convexity of the fixation sheet. A portion of toner transferred onto the convexity of the fixation sheet in a halftone part receives a much larger shearing force per toner particle because of a small toner layer thickness compared with that in a solid image part, thus being liable to cause offset or result in copy images of a lower image quality.

Fog is another problem. If the toner particle size is reduced, the surface area of a unit weight of toner is increased, so that the charge distribution thereof is liable to be broadened to cause fog. As the toner surface area is increased per unit weight thereof, the toner chargeability is liable to be affected by a change in environmental conditions.

If the toner particle size is reduced, the dispersion state of a charge control agent and a colorant is liable to affect the toner chargeability.

When such a small particle size toner is applied to a high-speed copying machine, the toner is liable to be excessively charged to cause fog and a density decrease, particularly in a low-humidity environment.

Further, in connection with a trend of providing a copying machine with a multiplicity of functions, such as a superposed multi-color copying by erasing a part of an image as by exposure and inserting another image into the erased part, or frame erasure of erasing a frame part on a copying sheet, fog of a small particle size is liable to remain in such a part to be erased into white.

When an image is erased by providing a potential of a polarity opposite to that of a latent image potential with respect to a development reference potential as by irradiation with intense light from LED, a fuse lamp, etc., the erased part is liable to cause fog.

JP-A 62-78569 has proposed a toner containing a polyester having a saturated or unsaturated hydrocarbon group with 3–22 carbon atoms in its side chain.

JP-A 63-225244 has proposed a toner containing two types of polyester as a binder resin.

Because of a poor compatibility (mutual solubility) between a polyester resin and polyolefin wax, however, such a toner is liable to cause a dispersion failure of polyolefin at the time of toner production, thus resulting in isolated polyolefin in the step of pulverizing cooled kneaded product. Particularly, in the case of using two types of polyester resins having different viscosities, the polyolefin is liable to be preferentially contained in the lower-viscosity polyester resin, so that the above difficulty is liable to be pronounced. This can lead to occurrence of cleaning failure and a lower anti-offset characteristic in a high-speed copying or printing apparatus. In such a high-speed apparatus, the fixability in a low-temperature environment and the developing performance in a low-humidity environment are not fully satisfactory.

JP-A 2-129653 and JP-A 3-46668 have proposed the use of a polyester resin treated with an acid or an alcohol as a binder resin.

Such toners are actually effective in providing an increased fixability and a stable triboelectric chargeability but are liable to result in dispersion failure of polyolefin wax because the mono-alcohol used has an alkyl group containing a number of carbon atoms as low as 10. This can lead to occurrence of cleaning failure and inferior anti-offset characteristic when used in a higher-speed apparatus, and the fixability in a low-temperature environment and the developing performance in a low-humidity environment cannot be said to be fully satisfactory.

Japanese Laid-Open Patent Application (JP-A) 59-129863 and JP-A 3-50561 have proposed the use of a polyester resin and an acid-modified polyolefin. According to the proposal, maleic anhydride is added to polyolefin which has been synthesized in advance. In case where an acid anhydride is added, the polarity obtained thereby is very weak, so that it is difficult to break an association of polymer OH groups. Accordingly, in an initial stage of copying, the charging speed is fast to provide a high charge because of association of polymer carboxylic groups. In this instance, the toner quantity used for development is large to provide high image density copies. However, as many associations of polymer OH groups are present, the saturation charge is gradually reduced so that the copy image density is gradually lowered correspondingly.

Maleic anhydride used in the above proposals reacts with water to open its ring but, even in such a case, the associatability of the resultant carboxylic group is lowered because of an adjacent carboxylic group. Further, maleic acid is not always attached to molecular chain terminals. Accordingly, when maleic acid is attached to a middle of a molecular chain, this is identical to branching of the molecule chain. Further, according to the proposed method utilizing a post addition reaction, it is very difficult to add one maleic acid to each molecular chain. Accordingly, plural carboxyl groups may be introduced into one molecule chain, thereby resulting in a lower associatability. In this case, the charging speed and the environmental stability are liable to be lowered.

U.S. Pat. No. 4,883,736, JP-A 4-97162 and JP-A 4-204543 disclose toner containing aliphatic alcohols. In such toners, however, no carboxylic group association is formed, so that the resultant charging speed is slow, whereby the density gradation characteristic of copy images is not stabilized in a digital copying machine.

JP-A 56-87051 has disclosed a method of producing a binder resin by polymerization in the presence of a higher fatty acid or a higher alcohol. However, the fatty acids and alcohols specifically disclosed therein have only a small number of carbon atoms, so that the resultant toner is caused to have low storage stability and low environmental stability.

JP-A 2-173038 and JP-A 3-46668 disclose reaction of a polyester resin with a monocarboxylic acid but the monocarboxylic acid used therein has a methylene group containing only less than 20 carbon atoms, and the resultant toner has left a room for improvement against problems, such as cleaning failure.

SUMMARY OF THE INVENTION

A generic object of the present invention is to provide a toner for developing electrostatic images having solved the above-mentioned problems.

A more specific object of the present invention is to provide a toner for developing electrostatic images showing excellent anti-offset characteristic and cleaning performance without impairing the fixability for a low-speed to a high-speed copying or printing apparatus.

Another object of the present invention is to provide a toner for developing electrostatic images, even in a small particle size, capable of showing a good fixability at a halftone part and providing copy images of good image quality for a low-speed to a high-speed copying or printing apparatus.

Another object of the present invention is to provide a tone for developing electrostatic images capable of providing high-density copy images free from fog for a low-speed to a high-speed copying or printing apparatus.

Another object of the present invention is to provide a toner for developing electrostatic images capable of providing good images in a low-humidity environment and also in a high-humidity environment without being affected by a change in environmental conditions.

Another object of the present invention is to provide a toner for developing electrostatic images capable of stably providing good images in a high-speed apparatus and thus applicable to wide variety of models of image forming apparatus.

Another object of the present invention is to provide a toner for developing electrostatic images having excellent durability and capable of providing copy or print images having a high image density and free from fog on white background even in a long period of continuous image formation on a large number of sheets.

Another object of the present invention is to provide copies of a photographic image with characters including clear character images and photographic images having a density gradation characteristic faithful to the original.

According to the present invention, there is provided a toner for developing an electrostatic image, comprising a resin composition and a colorant, wherein said resin composition-comprising a high-softening point polyester resin (I) having a softening point of 120°–180° C., a low-softening point polyester resin (II) having a softening point of 80° C.–120° C. (exclusive), and a long-chain alkyl compound selected from the group consisting of a long-chain alkyl alcohol principally comprising long-chain alkyl alcohol components having long-chain alkyl groups of 23 to 252 carbon atoms and a long-chain alkyl carboxylic acid principally comprising long-chain alkyl carboxylic acid compounds having long-chain alkyl groups of 22 to 251 carbon atoms.

According to another aspect of the present invention, there is provided a toner for developing an electrostatic image, comprising a resin composition and a colorant; said resin composition comprising a polyester resin, and a long-chain alkyl compound selected from the group consisting of a long-chain alkyl alcohol principally comprising long-chain alkyl alcohol components having long-chain alkyl groups of 23 to 252 carbon atoms and a long-chain alkyl carboxylic acid principally comprising long-chain alkyl carboxylic acid components having long-chain alkyl groups of 22 to 251 carbon atoms, and a colorant;

wherein said resin composition includes a tetrahydrofuran (THF)-soluble content providing a gel permeation chromatogram showing a weight-average molecular weight (Mw) of at least $10^5$, a ratio of Mw to number-average molecular weight (Mn) of at least 35 and an areal percentage of at least 5% of a region of molecular weight of at least $2\times10^5$.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
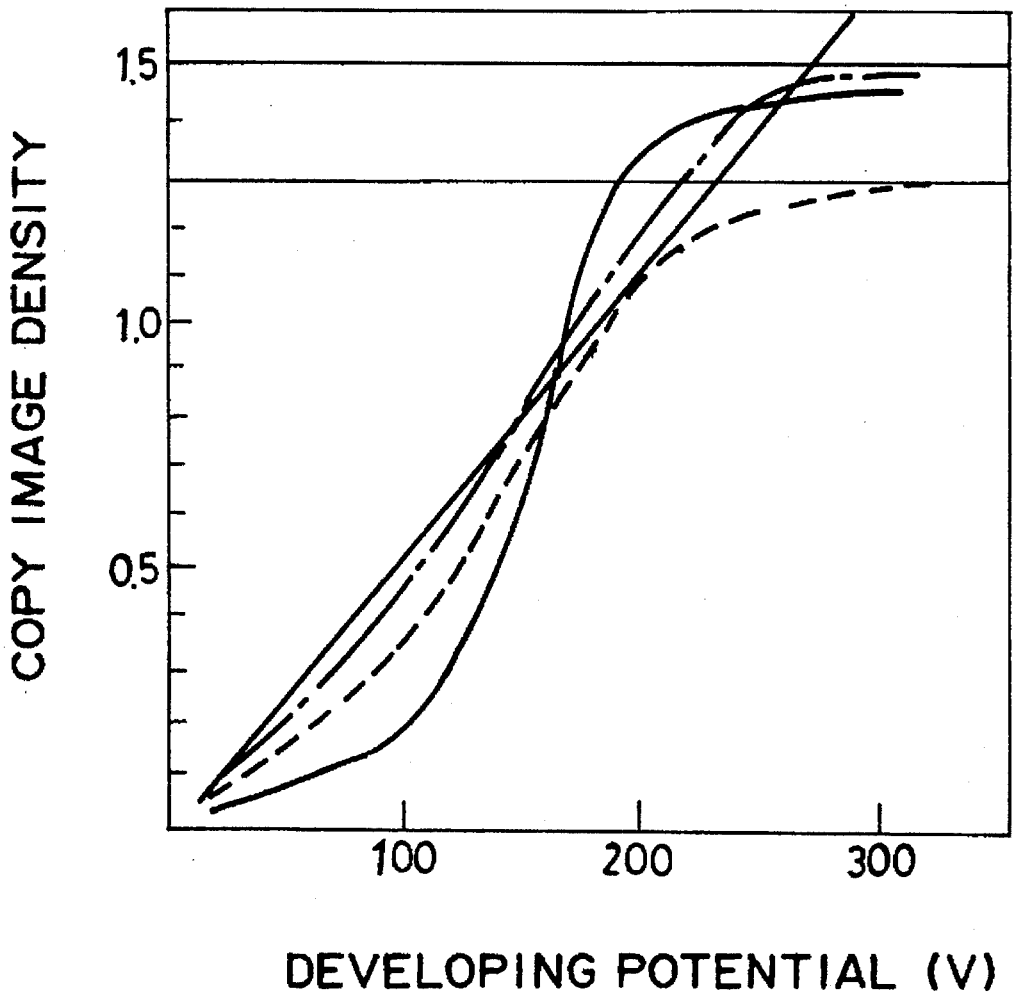
FIG. 1 is a graph showing a relationship between a developing potential and a fixed toner image density.

The toner for developing an electrostatic image according to the present invention contains a low-softening point polyester resin, a high-softening point polyester resin and a long-chain alkyl compound having a terminal hydroxyl or carboxyl group.

According to our detailed study, regarding the toner charging characteristics, it has been known that a carboxyl group has a function of providing an increased charging speed and an OH group has a function of providing a lower saturation charge. This is considered to be based on the following mechanism.

A carboxyl group is a functional group having a very strong polarity so that carboxyl groups can associate with each other to provide a state where polymer chains extend outwardly from the side of association. In case of two carboxyl groups, for example, the state of association may be represented as follows:

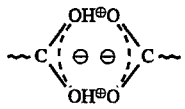

and the structure is considered to be stable and exhibit a strong orientation.

In view of the bond angle of a structure (O═C═O), four or more carboxyl groups are considered to form an assembly of associations. The thus formed assembly of carboxyl group associations is like a hole and therefore can easily accept a free electron. This is assumed to be a reason of accelerated charging speed. The association state is resistant to an external attack and particularly water cannot easily coordinate therewith. Accordingly, the environmental stability of the toner is retained to be good.

In case of OH groups, in contrast with carboxyl groups, associated two OH groups for example assume a state as follows:

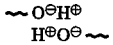

and accordingly the polarity is rather enhanced than in the case of a single OH group. The localized charge is not directed inwardly so that the state is susceptible of external attack. It is accordingly assumed that water can easily coordinate therewith.

Base on the above recognition, we have developed a toner showing a large charging speed, an appropriate saturation charge and excellent low-temperature fixability and anti-offset characteristic by using a combination of a long-chain alkyl carboxylic acid or alcohol and at least two polyester resins.

A long-chain alkyl carboxylic acid forms an association by itself. Accordingly, a long-chain alkyl carboxylic acid forms an association of carboxyl groups to contribute to an increase intoner charging speed. An OH group is susceptible of an external attack as described above, so that a —COOH group in a long-chain alkyl carboxylic acid has a function of collapsing an association of OH groups in a polyester polymer. However, a —COOH group of a long-chain alkyl carboxylic acid in a polymer matrix affects an environment surrounding a COOH association to rather increase the toner charging speed.

A long-chain alkyl alcohol also affects a COOH association in a polymer matrix to increase the toner charging velocity similarly as the long-chain alkyl carboxylic acid. A long-chain alkyl alcohol also affects OH groups in a polymer matrix, thereby functioning to reduce the localization of charge density as a whole. Accordingly, the resin is less susceptible of an external attack, particularly with water, thereby increasing the saturation charge of the toner.

It is important to use a long-chain alkyl carboxylic acid having a long-chain alkyl carboxylic acid having a long-chain alkyl group at least 22 carbon atoms or a long-chain alkyl alcohol having a long-chain alkyl group of at least 23 carbon atoms.

A carboxylic acid having a branched structure instead of a long-chain alkyl group causes a steric hindrance because of the branching, thereby lowering the associatability. The associatability of carboxylic groups is also lowered in case where plural carboxylic groups are present in one molecular chain. As the associatability of the carboxylic acid is lowered, the resultant toner is provided with a lower charging speed and an inferior environmental stability. In case of an alcohol having a branched structure instead of a long-chain alkyl group, the alcohol causes a steric hindrance because of the branching, so that it does not act on an OH group of the polymer, so that the resin is liable to be affected by moisture, thereby lowering the saturation charge. In case of plural OH groups in one molecular chain, the resin is also liable to be affected with moisture.

Each polyester resin used in the present invention may be prepared by appropriately selecting the following components.

The high-softening point polyester resin (I) used in the present invention may preferably comprise a non-linear polyester resin having a crosslinked or branched structure. The low-softening point polyester resin (II) may comprise either a linear polyester resin or a non-linear polyester resin but may preferably comprise a non-linear polyester resin.

Such a non-linear polyester resin may be synthesized by using a polycarboxylic acid having three or more carboxyl groups or a polyol having three or more alcohol groups together with a dicarboxylic acid and a diol.

The polyester resin used in the present invention may preferably comprise 45–55 mol. % of alcohol component and 55–45 mol. % of acid component.

Examples of the diol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols derivatives represented by the following formula (A):

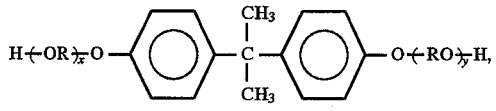

(A)

wherein R denotes an ethylene or propylene group, x and y are independently 0 or a positive integer with the proviso that the average of x+y is in the range of 0–10; and diols represented by the following formula (B):

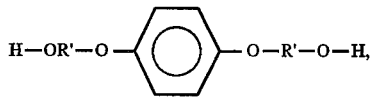

(B)

wherein R' denotes

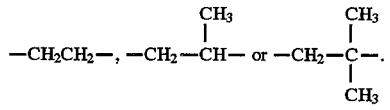

Examples of the dibasic carboxylic acid constituting at least 50 mol. % of the total acid may include benzenedicarboxylic acids, such as phthalic acid, terephthalic acid, isophthalic acid, diphenyl-p,p'-dicarboxylic acid, naphthalene-2,7-dicarboxylic acid, naphthalene-2,6-dicarboxylic acid, diphenylmethane-p,p'-dicarboxylic acid, benzophenone-4,4'-dicarboxylic acid and 1,2-diphenoxyethane-p,p'-dicarboxylic acid, and their anhydrides; alkyldicarboxylic acids, such as succinic acid, adipic acid, sebacic acid, azelaic acid, glutaric acid and cyclohexanedicarboxylic acid, and their anhydrides; $C_6$–$C_{18}$ alkyl or alkenyl-substituted succinic acids, and their anhydrides; unsaturated dicarboxylic acids, such as fumaric acid, maleic acid, citraconic acid and itaconic acid, and their anhydrides; and $C_6$–$C_{18}$ alkyl-substituted dicarboxylic acids and their anhydrides.

An especially preferred class of alcohol components constituting the polyester resin is a bisphenol derivative represented by the above formula (A), and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride.

Examples of the polycarboxylic acid having three or more carboxylic groups may include: trimellitic acid, pyromellitic acid, cyclohexane-tricarboxylic acids, 2,5,7-naphthalenetricarboxylic acid, 1,2,5-naphthalenetricarboxylic acid, 1,2,4-butanetricarboxylic acid, 1,2,5-hexanetricarboxylic acid, 1,3-dicarboxyl-2-methylenecarboxylpropane, 1,3-dicarboxyl-2-methyl-methylenecarboxylpropane, tetra(methylenecarboxyl) methane, ,2,7,8-octanetetracarboxylic acid, and their anhydrides.

Examples of the polyols having three or more hydroxyl groups may include: sorbitol, 1,2,3,6-hexanetetraol, 1,4-sorbitan, pentaerythritol, dipentaerythritol, tripentaerythritol, sucrose, 1,2,4-butanetriol, glycerin, 2-methylpropanetriol, trimethylolethane, trimethylolpropane, and 1,3,5-trihydroxymethylbenzene.

The polyester resin (I) obtained from the above components may have a softening point of 120°–180° C., preferably 125°–175° C., and may preferably be non-linear by crosslinking. The polyester resin (II) obtained also from the above components may have a softening point of 80° C.–120° C. (not inclusive), preferably 85°–115° C. A polyester resin (I) having a softening point below 120° C. provides a worse anti-offset characteristic at high temperatures, and a softening point exceeding 180° C. causes a poor fixability and poor mixing with the polyester resin (II), leading to poor electrophotographic performances and poor pulverizability during toner production. A polyester-resin (II) having a softening point below 80° C. results in a lower anti-blocking characteristic, and a softening point of 120° C. or higher leads to a worse fixability. The polyester resins (I) and (II) may preferably be both non-linear and have a difference in softening point of at least 10° C., more preferably at least 120° C., therebetween.

The polyester resin composition including the above-mentioned two types of polyester resins may preferably have a glass transition temperature (Tg) of 40°–90° C., more preferably 45°–85° C. The polyester resin composition may preferably have a number-average molecular weight (Mn) of 1,000–50,000, more preferably 1,500–20,000, particularly 2,500–10,000, and a weight-average molecular weight (Mw) of $3\times10^3$–$3\times10^6$, more preferably $1\times10^4$–$2.5\times10^6$, further preferably $4.0\times10^4$–$2.0\times10^6$. Within the above-described range, it is possible to obtain a good combination of fixability, anti-offset characteristic and anti-blocking characteristic.

The polyester resin composition may preferably have an acid value of 2.5–80 mgKOH/g, more preferably 5–60 mgKOH/g, further preferably 10–50 mgKOH/g, and an OH value of at most 80 mgKOH/g, more preferably at most 70 mgKOH/g, further preferably at most 60 mgKOH/g.

If the polyester resin composition has an acid value of below 2.5 mgKOH/g, few carboxylic group association assemblies of the binder resin are formed, thus being liable to result in a slow charging speed. If the polyester resin has an acid value exceeding 80 mgKOH/g, there remain many carboxyl groups not forming association assemblies in the polyester resin, thus being susceptible of attack with moisture and resulting in an inferior environmental stability. If the polyester resin has an OH value exceeding 80 mgKOH/g, many associates of OH groups are formed so that the polyester resin is susceptible of attack with moisture to result in a lower environmental stability.

The polyester resins (I) and (II) may be amply mixed with each other ordinarily by (i) adding the high-softening point polyester resin (I) into the low-softening point polyester resin in a molten state at an elevated temperature under stirring or (ii) blending them by a mixer such as a Henschel mixer or a ball mill.

In the present invention, it is also possible to add another resin, such as another polyester resin, modified polyester resin, vinyl resin, polyurethane, epoxy resin, polyvinyl butyral, rosin, modified rosin, terpene resin, phenolic resin, aliphatic or alicyclic resin, or aromatic petroleum resin, as desired, to the above-mentioned polyester resin composition including the polyester resins (I) and (II).

The long-chain alkyl alcohol used in the present invention may be represented by the following formula (1):

$$CH_3(CH_2)_xCH_2OH \quad (1),$$

wherein x denotes an average value in the range of 21–250, preferably 21–100.

The long-chain alkyl alcohol may for example be produced as follows. Ethylene is polymerized in the presence of a Ziegler catalyst and, after the polymerization, oxidized to provide an alkoxide of the catalyst metal and polyethylene, which is then hydrolyzed to provide an objective long-chain alkyl alcohol. The thus prepared long-chain alkyl alcohol has little branching and a sharp molecular weight distribution and is suitably used in the present invention.

The long-chain alkyl carboxylic acid used in the present invention may be represented by the following formula (2):

$$CH_3(CH_2)_yCOOH \quad (2),$$

wherein y denotes an average value in the range of 21–250, preferably 21–100.

The long-chain alkyl carboxylic acid may be produced by oxidizing the long-chain alkyl alcohol of the above formula (1).

The content (wt. %) of each long-chain alkyl alcohol component can be measured by the GC-MS analysis. For example, it may be possible to use a GC-MS analyzer ("VG TR10-1", available from VG Organic Co.) and a column of "DB-1" or "DB-5" (available from J & W Co.). In the analysis, it is preferred to silicate the long-chain alkyl alcohol components in advance of the GC-MS analysis. The content (wt. %) of each long-chain alkyl carboxylic acid can also be measured similarly.

The parameters x and y in the formulae (1) and (2) are respectively an average value. The parameters x and y as an average value may be 21–250, preferably 21–200. If x or y is below 21, the resultant toner is liable to cause a melt sticking onto the photosensitive member surface and show a lower storage stability. In case where the parameter x or y exceeds 250, the above-mentioned effect contributing to the toner chargeability is little.

The long-chain alkyl alcohol components having long-chain alkyl groups of 23 to 252 carbon atoms may preferably occupy at least 60 wt. %, more preferably at least 70 wt. %, of the total long-chain alkyl alcohol. The long-chain alkyl carboxylic acid components having long-chain alkyl groups of 22 to 251 carbon atoms may preferably occupy at least 60 wt. %, more preferably at least 70 wt. %, of the total long-chain alkyl carboxylic acid.

It is further preferred that the long-chain alkyl alcohol contains at least 50 wt. % of a long-chain alkyl alcohol component having at least 37 carbon atoms based on the total alkyl alcohol components. On the other hand, it is preferred that the long-chain alkyl carboxylic acid contains at least 50 wt. % of a long-chain alkyl carboxylic acid component having at least 38 carbon atoms based on the total alkyl carboxylic acid components. Unless these conditions are satisfied, the resultant toner is liable to cause a melt-sticking onto the photosensitive member surface and exhibit a lower storage stability.

The long-chain alkyl alcohol or long-chain alkyl carboxylic acid used in the present invention may preferably have a melting point of at least 91° C. If the melting point is below 91° C., the long-chain alkyl alcohol or long-chain alkyl carboxylic acid is liable to be separated by melting during the melt-kneading step for toner production, and show an inferior dispersibility in toner particles. The resultant toner is liable to cause a melt-sticking onto the photosensitive member surface and show a lower storage stability. Further, because of a difference in flowability among toner particles, the toner is liable to have ununiform chargeability, cause fog and provide rough images.

The long-chain alkyl alcohol or long-chain alkyl carboxylic acid may preferably have a weight-average molecular weight (Mw) of 500–10,000, more preferably 600–8,000, and a Mw/Mn ratio of at most 3, more preferably at most 2.5, so as to suppress the toner melt-sticking onto the photosensitive member and provide an improved storage stability of the toner.

The long-chain alkyl alcohol used in the present invention may preferably have an OH value of 10–120 mgKOH/g, further preferably 20–100 mgKOH/g. If the long-chain alkyl alcohol has an OH value below 10 mgKOH/g, the effect thereof on the carboxyl group and OH group of the binder resin (polyester resin), and the dispersibility thereof in the binder resin is lowered to result in ununiform toner chargeability leading to a density decrease, fog, and inferior image quality in copy images. In case where the long-chain alkyl alcohol has an OH value exceeding 120 mgKOH/g, the localization of the OH group charge density is increased to exceed the charge density localization of the OH groups in the binder resin, thus lowering the above-mentioned effect of alleviating the charge density localization of the OH groups in the binder resin. As a result, copy images in the initial stage of image formation are liable to have a low density and a poor image quality. Alternatively, even if the initial density is high, the density is liable to be lowered gradually on continuation of copying. Further, in case where the OH value exceeds 120 mgKOH/g, the long-chain alkyl alcohol is caused to contain a large amount of low-molecular weight molecules so that the resultant toner is liable to cause a melt-sticking onto the photosensitive member and lower the storage stability.

The long-chain alkyl carboxylic acid used in the present invention may preferably have an acid value of 5–120 mgKOH/g, further preferably 10–100 mgKOH/g. If the long-chain alkyl carboxylic acid has an acid value below 5 mgKOH/g, the effect thereof onto the OH groups in the binder resin becomes small and the dispersion thereof in the binder resin is also worse, thereby resulting in inferior image qualities of copy images, similarly as in the case of the long-chain alkyl alcohol. Further, as the carboxyl group do not sufficiently associate each other, the environmental characteristic is liable to be impaired. Further, the resultant toner is liable to show a low charging velocity, to result in a lower density at the initial stage of copying. In case where the acid value of the long-chain alkyl carboxylic acid exceeds 120 mgKOH/g, it contains a large amount of low-molecular weight molecules, the resultant toner is liable to cause melt-sticking onto the photosensitive member and lower the storage stability, similarly as in the case of the long-chain alkyl alcohol.

The long-chain alkyl alcohol and/or the long-chain alkyl carboxylic acid may preferably be contained in an amount of 0.1–30 wt. parts, particularly 0.5–20 wt. parts, per 100 wt. parts of the binder resin. Below 0.1 wt. part, the above-mentioned effect cannot be exhibited sufficiently. Above 30 wt. parts, the anti-blocking characteristic of the resultant toner is lowered and the pulverizability in toner production becomes inferior.

It is preferred that the polyester resin composition further contains polyester resin (III), at least a portion of which has been modified with a long-chain alkyl compound having a long-chain alkyl group of 23–102 carbon atoms and a terminal hydroxyl or carboxyl group.

If the binder resin composition contains such a polyester resin (III) having introduced a long-chain alkyl group of 23–102 carbon atoms, the resultant toner is provided with further improved low-temperature fixability and releasability, is less liable to cause a dispersion failure of a long-chain alkyl compound, such as polyolefin wax, in the resin composition even when such a long-chain alkyl compound is contained, and is less liable to cause cleaning failure. Further, fine powder fraction produced during toner production can be re-used for toner production without causing a lower performance in developability or fixability in the resultant toner. These effects may be attributable to the phenomena that (a) the modified polyester resin (III) shows good compatibility with the polyester resins (I) and (II), (b) the modified polyester resin (III) promotes the uniform dispersion of a charge control agent and a colorant, such as a magnetic material, and (c) the molecular chain severance during the melt-kneading during toner production including re-cycled fine powder fraction and the other materials occurs seldom in the state where the modified polyester resin (III) is uniformly dispersed.

The modified polyester resin (III) used in the present invention may be produced by using a long-chain alkyl alcohol of the following formula (1') as a modifier compound:

$$CH_3(CH_2)_xCH_2OH \quad (1'),$$

wherein x denotes an average value in the range of 21–100.

The long-chain alkyl alcohol of the formula (1') may have a low melting point of 70°–140° C., and provides an effect of providing a lower fixing temperature by connection thereof to an intermediate yet-unreacted carboxyl group to provide a branched structure or connection to a terminal of the polyester main chain.

The modification further provides an improved mutual solubility between the polyester resin composition and a long-chain alkyl compound such as polyolefin wax, to prevent a dispersion failure of the long-chain alkyl compound in the polyester resin composition. The addition of the long-chain alkyl group may further provide an improved releasability from the fixing roller and an improved anti-offset characteristic.

The polyester resin (III) modified with the long-chain alkyl alcohol of the formula (1') may prevent successive chargeability and provide a stable chargeability.

The average value x in the formula (1') for the modifier long-chain alkyl alcohol may be in the range of 21–100. If x is below 21, the effect of lowering the toner fixation temperature is scarce and the addition in a large amount for the purpose of lowering the fixation temperature is liable to provide a poor storage stability. Further, little slippage-imparting effect against the photosensitive member is attained to result in a difficulty, such as cleaning failure. If x is larger than 100, the modified polyester resin (III) is caused to have a large melting point, thus providing little effect of lowering the fixation temperature.

Such long-chain alkyl alcohols may be produced the processes disclosed, e.g., in U.S. Pat. Nos. 2,892,858; 2,781,419; 2,787,626 and 2,835,689; and U.K. Patent No. 808,055.

For example, such a long-chain alkyl alcohol may for example be produced as follows. Ethylene is polymerized in the presence of a Ziegler catalyst and, after the polymerization, oxidized to provide an alkoxide of the catalyst metal and polyethylene, which is then hydrolyzed to provide an objective long-chain alkyl alcohol. The thus prepared long-chain alkyl alcohol has little branching and a sharp molecular weight distribution and is suitably used in the present invention.

The modifier long-chain alkyl alcohol may have a number-average molecular weight (Mn) of 150–4,000, preferably 250–2,500, and a weight-average molecular weight (Mw) of 250–10,000, preferably 400–8,000.

The modifier long-chain alkyl alcohol may have an OH value of 5–150 mgKOH/g, preferably 10–120 mgKOH/g. If the OH value of the long chain alkyl alcohol is below 5 mgKOH/g, the dispersibility in the binder resin is lowered to provide also low dispersibility of the charge control agent and colorant. As a result, the toner chargeability is liable to be ununiform, leading to difficulties, such as a lowering in density of copy or print images and fog causing inferior image quality. If the OH value is above 150 mgKOH/g, long-chain alkyl alcohol components of low molecular weight are contained in a substantial quantity to result in a lower storage stability.

In the present invention, by modifying a portion of the carboxyl groups and hydroxyl groups in the polyester resin to introduce a long-chain alkyl group into the binder resin, the following effects (a)–(c) are promoted.

(a) The control of the melt viscosity of the resin component becomes easier to provide an improved fixability onto paper.

(b) The mutual solubility between the resin component and the long-chain alkyl compound to provide an improved dispersibility of the long-chain alkyl compound in the resin component, thus providing an improved anti-offset characteristic and less liability of cleaning failure during continuous image formation in a high-speed apparatus. Further, by adding a long-chain alkyl group containing 30 or more carbon atoms to the polyester resin (III), it becomes possible to provide a sufficient releasability from the fixing roller and an improved anti-offset characteristic.

(c) The acid value affecting the toner characteristic can be controlled, so that excessive charge can be avoided even in a low-humidity environment, thereby providing a stabler chargeability and a better developing performance.

Alternatively, the modified polyester resin (III) may also be produced by using a long-chain alkyl carboxylic acid of the following formula (2') as a modifier compound:

$$CH_3(CH_2)_yCOOH \quad (2'),$$

wherein y denotes an average value in the range of 21–100. The long-chain alkyl carboxylic acid of the formula (2') may be produced by oxidizing the long-chain alkyl alcohol of the formula (1').

The long-chain alkyl carboxylic acid of the formula (2') may have a low melting point of 70°–140° C., and provides an effect of providing a lower fixing temperature by connections thereof to an intermediate yet-unreacted hydroxyl group to provide a branched structure or connection to a terminal hydroxyl group of the polyester main chain.

Further, the long-chain alkyl carboxylic acid modifier of the formula (2') provides an excellent releasability, thus providing a good high-temperature anti-offset characteristic. Further, by reaction of the long-chain alkyl carboxylic acid of the formula (2') with yet-unreacted hydroxyl groups at the terminal or within the polymer chain, the total number of hydroxyl groups in the polyester resin can be reduced, thus providing a good environmental stability.

The average value y in the formula (2') for the modifier long-chain alkyl carboxylic acid may be in the range of 21–100. If y is below 21, the effect of lowering the toner fixation temperature is scarce and the addition in a large amount for the purpose of lowering the fixation temperature is liable to provide a poor storage stability. Further, little slippage-imparting effect against the photosensitive member is attained to result in a difficulty, such as cleaning failure. If y is larger than 100, the modified polyester resin (III) is caused to have a large melting point, thus providing little effect of lowering the fixation temperature.

The modifier long-chain alkyl carboxylic acid may have a number-average molecular weight (Mn) of 150–4,000, preferably 250–2,500, and a weight-average molecular weight (Mw) of 250–10,000, preferably 400–8,000.

The modifier long-chain alkyl carboxylic acid may have an acid value of 5–150 mgKOH/g, preferably 10–120 mgKOH/g. If the acid value of the long chain alkyl carboxylic acid is below 5 mgKOH/g, the dispersibility in the binder resin is lowered to provide images of inferior qualities similarly as in the case of the long-chain alkyl alcohol. If the acid value is above 150 mgKOH/g, long-chain alkyl carboxylic acid components of low molecular weight are contained in a substantial quantity to result in a lower storage stability, similarly as in the case of the long-chain alkyl alcohol.

The modified polyester resin (III) may be produced by modifying a polyester resin with such a modifier compound having a long-chain alkyl of 23 to 102 carbon atoms, and a terminal hydroxyl or carboxyl group, i.e., the long-chain alkyl alcohol of the formula (1') or the long-chain alkyl carboxylic acid of the formula (2'), e.g., in the following manners.

(i) During a step of producing a polyester resin for providing the modified polyester resin (III), the above-mentioned modifier compound is charged together with the polybasic acids and polyhydric alcohols, and the mixture is subjected to reaction in the presence of a catalyst, such as calcium phosphate, ferric chloride, zinc chloride, organometallic salt of tin or titanium, or tin oxide, at a temperature of 160°–270° C. under a reduced pressure or under azeotropic distillation using a solvent, while removing the resultant water, thereby obtaining a modified polyester resin.

(ii) A once-produced polyester resin is modified by reaction of yet-unreacted carboxyl groups and/or hydroxyl groups with the above-mentioned modifier compound in the presence of the above-mentioned catalyst at a temperature of 160°–270° C. under a reduced pressure or under azeotropic distillation using a solvent, while removing the by-produced water to obtain modified polyester resin.

Among the above-mentioned methods, the method (i) of effecting the modification simultaneously with the synthesis of a polyester resin to be modified is preferred. This is because the modification simultaneous with the polyester resin synthesis allows a faster reaction, an easier molecular weight control and a higher modification rate. The modified polyester resin (III) produced by this method is caused to have a matrix-domain structure wherein the polyester portion constitutes a matrix (or domains) and the modifier compound portion constitutes domains (or a matrix), providing very minute uniformly dispersed domains.

In the present invention, it is preferred that the long-chain alkyl alcohol or carboxylic acid for providing the modified polyester resin (III) occupies 0.05–30 wt. %, more preferably 0.1–25 wt. of the total binder resin.

If the content of the modifier compound is below 0.05 wt. %, the dispersibility of the non-reacted long-chain alkyl alcohol, long-chain alkyl carboxylic acid, release agent, charge control agent, and colorant is lowered, thus being liable to cause a non-uniform toner chargeability leading to image quality degradation. Further, when classified fine powder is recycled during toner production, the resultant toner is liable to provide further lower image qualities.

If the content of the long-chain alkyl alcohol or long-chain alkyl carboxylic acid in the modified polyester resin (III) exceeds 30 wt. % of the total binder resin, the dispersibility of the charge control agent, etc., is good but the toner chargeability is rather lowered because the modifying alkyl portion in the polyester resin shows a weak chargeability, thus being liable to provide lower image qualities. Further, in this case, the pulverizability during toner production becomes worse, so that it becomes difficult to provide fine particles of the toner.

The non-linear polyester resin composition in the toner may preferably have a number-average molecular weight (Mn) of 1,000–50,000, more preferably 1,500–20,000 and a weight-average molecular weight (Mw) of $3\times10^3$–$2\times10^6$, more preferably $4\times10^4$–$1.5\times10^6$. The non-linear polyester resin composition may preferably show a glass transition point (Tg) of 40°–80° C., more preferably 45°–70° C.

In the toner according to the present invention, it is preferred that the following formula [I] is satisfied:

[Acid value of the polyester resin composition+OH value of long-chain alkyl alcohol+Acid value of long-chain alkyl carboxylic acid]>(¼)×OH value of the polyester resin composition [I]

The above formula represents a preferred condition so that a substantial amount of carboxyl group is present in the polyester resin effective for suppressing the function of OH groups in the polymer to provide an accelerated chargeability of the toner. The coefficient of ¼ preceding the OH value is attributable to a weak dissociation of the OH group. In other words, this is attributable to the fact that all of the OH groups do not associate because of little localization in electron density as described above.

As a result, the polyester resin composition constituting the binder resin of the toner according to the present invention may contain a tetrahydrofuran (THF)-soluble content providing a gel-permeation chromatogram showing a weight-average molecular weight (Mw) of at least $10^5$, preferably at least $1.5\times10^5$, a ratio (Mw/Mn) of weight-average molecular weight (Mw) to number-average molecular weight (Mn) of at least 35, more preferably at least 45, and an areal percentage for a molecular weight region of at least $2\times10^5$ of at least 5%, more preferably at least 7%, so as to provide better low temperature-fixability and anti-offset characteristic.

In the toner for developing electrostatic images according to the present invention, it is possible to add a charge control agent, as desired, in order to further stabilize the chargeability thereof. The charge control agent may be used in 0.1–10 wt. parts, preferably 0.1–5 wt. parts, per 100 wt. parts of the binder resin.

Examples of the charge control agents may include the following.

Examples of negative charge control agents may include: organometal complexes and chelate compounds, inclusive of mono-azo metal complexes; acetylacetone metal complexes; aromatic hydroxycarboxylic acid metal complexes or metal salts and aromatic dicarboxylic acid metal complexes or metal salts. Other examples may include: aromatic mono- and poly-carboxylic acids, metal salts, anhydrides and esters of these acids, and phenol derivatives of bisphenols.

Examples of the positive charge control agents may include: nigrosine and products of modification thereof with aliphatic acid metal salts, etc.; onium salts inclusive of quaternary ammonium salts, such as tributylbenzylammonium-1-hydroxy-4-naphthosulfonate and tetrabutylammonium tetrafluoroborate, and their homologues, such as phosphonium salts, and lake pigments thereof; triphenylmethane dyes and lake pigments thereof (the laking agents including phosphotungstic acid, phosphomolybdic acid, phosphomolybdic-tungstic acid, tannic acid, lauric acid, gallic acid, ferricyanic acid, ferrocyanic acid, ferrocyane compounds, etc.); metal salts of higher fatty acids; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in combination of two or more species. Among these, nigrosine compounds and quaternary ammonium salts are particularly preferred.

The toner for developing electrostatic image according to the present invention may be either a magnetic toner or a non-magnetic toner. In case of the magnetic toner, it is preferred to use a magnetic material as shown below for providing uniform chargeability, flowability, copy or print image density, etc.

Examples of such a magnetic material also functioning as a colorant, may include: iron oxide, such as magnetite, hematite, and ferrite; iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). The above magnetic materials may be used singly or in mixture of two or more species. Particularly suitable magnetic material for the present invention is fine powder of triiron tetroxide or $\gamma$-diiron trioxide.

The magnetic material may have an average particle size (Dav.) of 0.1–2 μm, preferably 0.1–0.5 μm. The magnetic material may preferably show magnetic properties when measured by application of 10 kilo-Oersted, inclusive of: a coercive force (Hc) of 20–200 Oersted, more preferably 20–150 Oersted, a saturation magnetization ($\sigma s$) of 50–200 emu/g, particularly 50–100 emu/g, and a residual magnetization (or) of 2–25 emu/g, particularly 2–20 emu/g.

The magnetic material may be contained in the toner in a proportion of 10–200 wt. parts, preferably 20–150 wt. parts, per 100 wt. parts of the binder resin.

The toner according to the present invention may contain appropriate dye or pigment as a non-magnetic colorant, particularly for providing a non-magnetic toner.

Blue 45, and copper phthalocyanine pigments represented by the following formula and having a phthalocyanine skeleton to which 1–5 phthalimidomethyl groups are added:

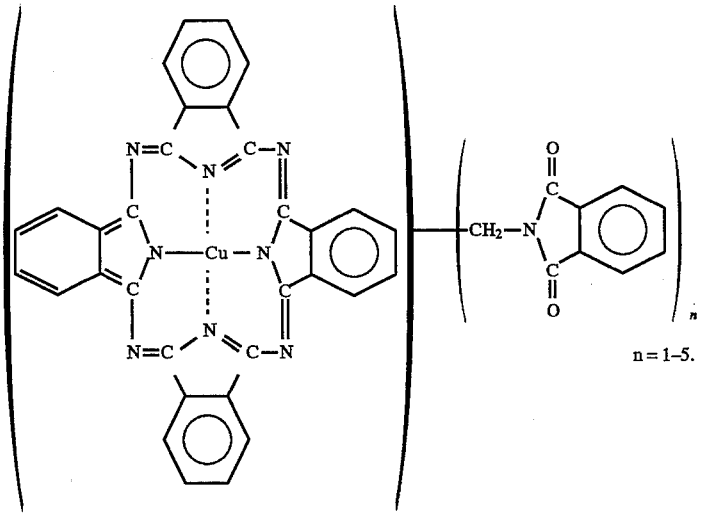

n = 1–5.

Examples of the dye may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

Examples of the pigment may include: Chrome Yellow, Cadmium Yellow, Mineral Fast Yellow, Navel Yellow, Naphthol Yellow S, Hansa Yellow G, Permanent Yellow NCG, Tartrazine Lake, Orange Chrome Yellow, Molybdenum Orange, Permanent Orange GTR, Pyrazolone Orange, Benzidine Orange G, Cadmium Red, Permanent Red 4R, Watchung Red Ca salt, eosine lake; Brilliant Carmine 3B; Manganese Violet, Fast Violet B, Methyl Violet Lake, Ultramarine, Cobalt Blue, Alkali Blue Lake, Victoria Blue Lake, Phthalocyanine Blue, Fast Sky Blue, Indanthrene Blue BC, Chrome Green, chromium oxide, Pigment Green B, Malachite Green Lake, and Final Yellow Green G.

In case of providing the toner according to the present invention as toners for full-color image formation. The toner may contain appropriate pigment or dye as described below.

Examples of the magenta pigment may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Violet 1, 2, 10, 13, 15, 23, 29, 35.

The above magenta pigments may be used alone but can also be used in combination with a dye so as to increase the clarity for providing a color toner for full color image formation. Examples of the magenta dyes may include: oil-soluble dyes, such as C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; C.I. Disperse Violet 1; and basic dyes, such as C.I. Basic Red 1 , 2, 9, 12, 13, 14, 15, 17, 18, 22, 23, 24, 27, 29, 32, 34, 35, 36, 37, 38, 39, 40; C.I. Basic Violet 1, 3, 7, 10, 14, 15, 21, 25, 26, 27, 28.

Other pigments may include cyan pigments, such as C.I. Pigment Blue 2 , 3, 15, 16, 17; C.I. Vat Blue 6, C.I. Acid Examples of yellow pigment may include: C.I. Pigment Yellow 1, 2, 3, 4, 5, 6, 7, 10, 11, 12, 13, 14, 15, 16, 17, 23, 65, 73, 83; C.I. Vat Yellow 1, 13, 20.

Such a non-magnetic colorant may be added in an amount of 0.1–60 wt. parts, preferably 0.5–50 wt. parts, per 100 wt. parts of the binder resin.

In the present invention, it is also possible to incorporate one or two or more species of release agent in addition to the above-mentioned long-chain alkyl compound, as desired, within toner particles.

Examples of the release agent may include: aliphatic hydrocarbon waxes, such as low-molecular weight polyethylene, low-molecular weight polypropylene, microcrystalline wax, and paraffin wax, oxidation products of aliphatic hydrocarbon waxes, such as oxidized polyethylene wax, and block copolymers of these; waxes containing aliphatic esters as principal constituents, such as carnauba wax, montanic acid ester wax, and partially or totally deacidified aliphatic esters, such as deacidified carnauba wax. Further examples of the release agent may include: saturated linear aliphatic acids, such as palmitic acid, stearic acid, and montanic acid; unsaturated aliphatic acids, such as brassidic acid, eleostearic acid and parinaric acid; saturated alcohols, such as stearyl alcohol, behenyl alcohol, ceryl alcohol, and melissyl alcohol; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, and ethylene-biscaprylamide; unsaturated aliphatic acid amides, such as ethylene-bisolerylamide, hexamethylene-bisoleylamide, N,N'-dioleyladipoylamide, and N,N'-dioleylsebacoylamide, aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

The particularly preferred class of release agent (wax) in the present invention may include aliphatic hydrocarbon waxes because of good dispersibility within the resin. Specific examples of the wax preferably used in the present invention may include e.g., a low-molecular weight alkylene polymer obtained through polymerization of an alkylene by radical polymerization under a high pressure or in the presence of a Ziegler catalyst under a low pressure; an alkylene polymer obtained by thermal decomposition of an alkylene polymer of a high molecular weight; and a polymethylene hydrocarbon wax obtained by subjecting a mixture gas containing carbon monoxide and hydrogen to the Arge process to form a hydrocarbon mixture and distilling the hydrocarbon mixture to recover a residue. Fractionation of wax may preferably be performed by the press sweating method, the solvent method, vacuum distillation or fractionating crystallization. As the source of the hydrocarbon wax, it is preferred to use polymethylene hydrocarbons having up to several hundred carbon atoms as obtained through synthesis from a mixture of carbon monoxide and hydrogen in the presence of a metal oxide catalyst (generally a composite of two or more species), e.g., by the Synthol process, the Hydrocol process (using a fluidized catalyst bed), and the Arge process (using a fixed catalyst bed) providing a product rich in waxy hydrocarbon, and hydrocarbons obtained by polymerizing an alkylene, such as ethylene, in the presence of a Ziegler catalyst, as they are rich in saturated long-chain linear hydrocarbons and accompanied with few branches. It is further preferred to use polymethylene hydrocarbon waxes synthesized without polymerization because of their structure and molecular weight distribution suitable for easy fractionation.

As for the molecular weight distribution of the release agent, it is preferred that the release agent shows a peak in a molecular weight region of 400–2400, further 450–2000, particularly 500–1600. By satisfying such molecular weight distribution, the resultant toner is provided with preferable thermal characteristics.

The release agent, when used, may preferably be used in an amount of 0.1–20 wt. parts, particularly 0.5–10 wt. parts, per 100 wt. parts of the binder resin. The release agent may be uniformly dispersed in the binder resin by a method of mixing the release agent in a solution of the resin at an elevated temperature under stirring or melt-kneading the binder resin together with the release agent.

A flowability-improving agent may be blended with the toner to improve the flowability of the toner. Examples thereof may include: powder of fluorine-containing resin, such as polyvinylidene fluoride fine powder and polytetrafluoroethylene fine powder; and fine powdery silica such as wet-process silica and dry-process silica, and treated silica obtained by surface-treating (hydrophobizing) such fine powdery silica with silane coupling agent, titanium coupling agent, silicone oil, etc. It is also preferred to use titanium oxide fine powder, aluminum oxide fine powder, and surface-treated products of such fine powders.

A preferred class of the flowability-improving agent includes dry process silica or fumed silica obtained by vapor-phase oxidation of a silicon halide. For example, silica powder can be produced according to the method utilizing pyrolyric oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention. It is preferred to use fine silica powder having an average primary particle size of 0.001–2 μm, particularly 0.002–0.2 μm.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | OX 50 |
| | TT 600 |
| | MOX 80 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

It is further preferred to use treated silica fine powder obtained by subjecting the silica fine powder formed by vapor-phase oxidation of a silicon halide to a hydrophobicity-imparting treatment. It is particularly preferred to use treated silica fine powder having a hydrophobicity of 30–80 as measured by the methanol titration test.

Silica fine powder may be imparted with a hydrophobicity by chemically treating the powder with an organosilicon compound, etc., reactive with or physically adsorbed by the silica fine powder.

Example of such an organosilicon compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

The flowability-improving agent may have a specific surface area of at least 30 $m^2/g$, preferably 50 $m^2/g$, as measured by the BET method according to nitrogen adsorption. The flowability-improving agent may be used in an amount of 0.01–8 wt. parts, preferably. 0.1–4 wt. parts, per 100 wt. parts of the toner.

The toner according to the present invention may be used as a mono-component type developer or a toner for a two-component type developer composed of such a toner and a carrier.

In the case of using the toner according to the present invention for constituting a two-component type developer, the carrier plays an important role for having the toner fully exhibit its performances. The carrier may comprise, for example, surface-oxidized or unoxidized powder of metals, such as iron, nickel, copper, zinc, cobalt, manganese, chromium, and rare earth metals, alloys and oxides of these, and ferrites. The carrier may be produced through various processes without particular restriction.

Coated carriers obtained by coating the above-mentioned carrier material with a solid coating material, such as a resin, are particularly preferred. Various known coating methods may be adopted, inclusive of application of a solution or suspension liquid of a solid coating material, such as a resin, in a solvent, and blending in a powder form.

Examples of the solid carrier-coating material may include: polytetrafluoroethylene, monochlorotrifluoroethylene, polyvinylidene fluoride, silicone resin, polyester resin, styrene resin, acrylic resin, polyamide, polyvinyl butyral, and amino-acrylate resin. These coating materials may be used singly or in mixture of two or more species.

The coating rate may preferably be 0.1–30 wt. %, more preferably 0.5–20 wt. %, of the total carrier. The carrier may preferably have an average particle size of 10–100 μm, more preferably 20–70 μm.

As a particularly preferred mode, the carrier may comprise magnetic ferrite particles, surface coated with 0.01–5 wt. %, preferably 0.1–1 wt. %, of fluorine-containing resin, silicone resin, styrene resin, acrylic resin, etc., and having a particle size distribution including at least 70 wt. % of particles of 250 mesh-pass and 400 mesh-on so as to provide the above-mentioned average particle size. Such coated ferrite carrier particles have a sharp particle size distribution and provide a preferable triboelectric charge and thus improved electrophotographic performances to the toner according to the present invention.

A two-component type developer may be prepared by blending the toner and carrier in such a mixing ratio as to provide a toner concentration in the developer of preferably 2–15 wt. %, more preferably 4–13 wt. %, which generally provides good performances.

The toner according to the present invention may be prepared by sufficiently blending the binder resin, the long-chain alkyl compound, a magnetic or non-magnetic colorant, and a charge control agent or other additives, as desired, by a blender such as a Henschel mixer or a ball mill, followed by melt-kneading for mutual dissolution of the resins of the blend, cooling for solidification of the kneaded product, pulverization and classification to recover a toner product.

The toner may be further sufficiently blended with an external additive such as a flowability-improving agent having a chargeability to a polarity identical to that of the toner by a blender such as a Henschel mixer to obtain a toner according to the present invention, wherein the external additive is carried on the surface of the toner particles.

Various parameters referred to herein inclusive of those described in Examples appearing hereinafter are based on values measured in the following manner.

(1) Softening Point

An accurately weighed 1 g of a powdery sample is pressed for 5 min. under a load of 300 kg to provide a cylindrical pellet sample having a sectional area of 1 $cm^2$. The pellet sample is placed in a flow tester ("CFT-500C", mfd. by Shimazu Seisakusho K.K.) and subjected to a melt-flow test through a vertically disposed orifice under a plunger load under the following conditions, and a temperature at which a half of the sample is extruded (i.e., the plunger descent corresponds to a half of the flow-out initiation point and the flow-out termination point) is taken as a softening point.

[Conditions]

plunger weight=20 kg orifice, diameter=1 mm, length=1.0 mm temperature-raising rate=6° C./min.

measurement initiation temperature=75° C.

preheating time=300 sec.

Figure 4:
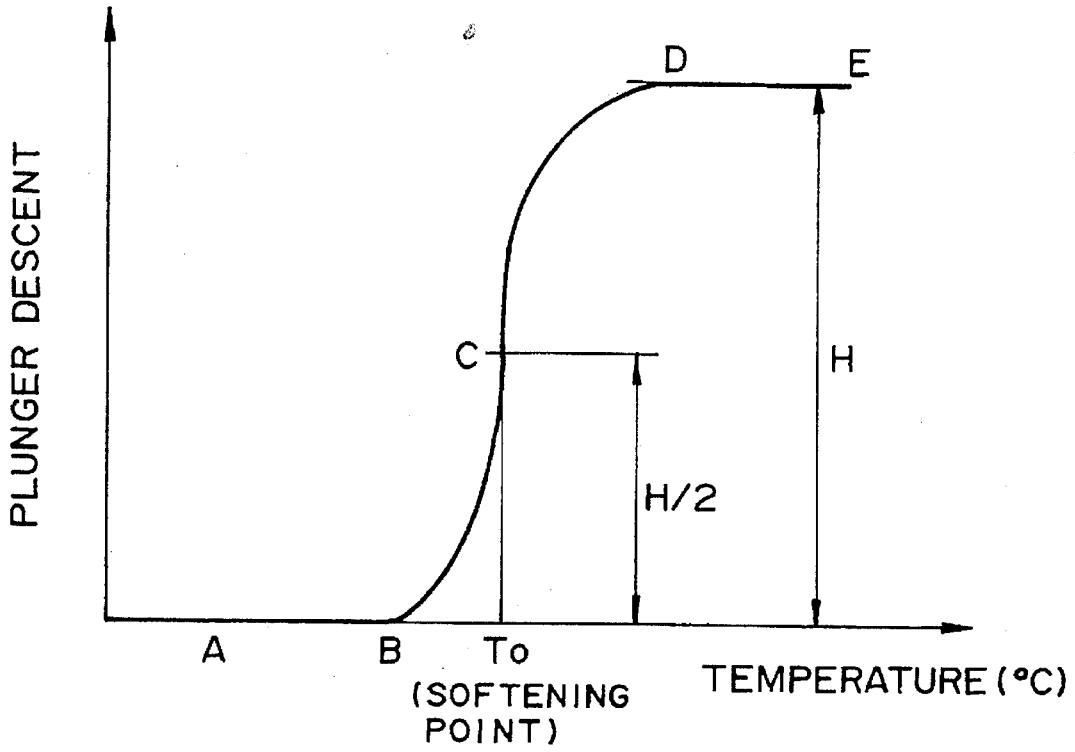
FIG. 4 is a graph showing a relationship between temperature and amounts of plunger descent for measuring the softening points of resins, etc.

The manner of the melt-flow test is described in more detail with reference to FIG. 4. The sample in the flow tester is preheated for 300 sec. and then heated at a constant temperature-raising rate of 6° C./min for extrusion under a plunger load of 20 $kg/cm^2$ to obtain a plunger descent-temperature curve (called a "softening S-character curve"). A typical example of the softening S-character curve is shown in FIG. 4. During the constant rate of temperature raising, the pellet sample is gradually heated to initiate the flow-out through the orifice (points A→B in FIG. 4). On further heating, the melted sample is caused to flow out through the orifice at a remarkably increased rate (points B→C→D), thus completing the flow-out accompanied with the termination of the plunger descent (D→E).

The height H on the softening S-character curve corresponds to the total flow-out amount, and a temperature $T_O$ corresponding to the point C (a height of H/2) provides a softening point of the sample.

(2) Glass Transition Temperature Tq

Measurement may be performed in the following manner by using a differential scanning calorimeter ("DSC-7", available from Perkin-Elmer Corp.) according to ASTM D3418-82.

A sample in an amount of 5–20 mg, preferably about 10 mg, is accurately weighed.

The sample is placed on an aluminum pan and subjected to measurement in a temperature range of 30°–200° C. at a temperature-raising rate of 10° C./min in parallel with a blank aluminum pan as a reference.

In the course of temperature increase, an absorption peak attributable to a principal binder resin component generally appears in the temperature region of 40°–80° C., and an absorption peak attributable to a long-chain alkyl alcohol or carboxylic acid generally appears in the temperature region of 70°–140° C.

Figure 5:
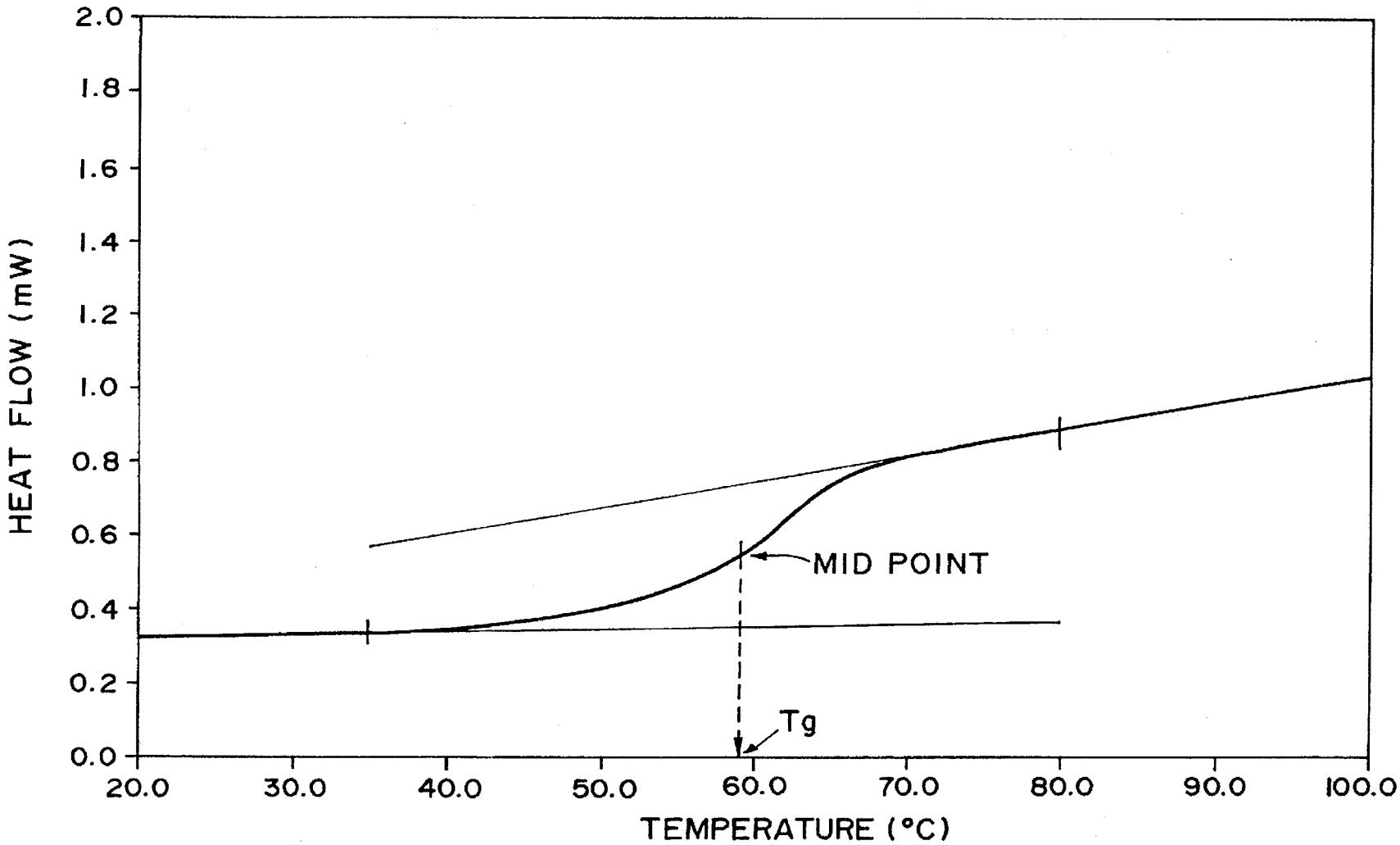
FIG. 5 is a DSC (differential scanning calorimeter) curve for determining a Tg (glass transition temperature).

In this instance, the glass transition temperature is determined as a temperature of an intersection of a DSC curve and an intermediate line pressing between the base lines obtained before and after the appearance of the absorption peak (i.e., a temperature of a mid point on the DSC curve). An example of a heat absorption cube is shown in FIG. 5.

(3) Melting Point (m.p) of Long-Chain Alkyl Alcohol or Long-Chain Alkyl Carboxylic Acid The sample may be a starting material thereof or a (non-reacted) long-chain alkyl alcohol or long-chain alkyl carboxylic acid recovered from a toner in a manner described in (9) (A) appearing hereinafter. The sample is subjected to a DSC analysis similarly as the measurement of the glass transition temperature and generally provides a heat absorption peak in the range of 70°–140° C., of which the temperature is taken as a melting point (m.p.).

(4) Acid Value

A sample material is accurately weighed and dissolved in a mixture solvent, and water is added thereto. The resultant liquid is titrated with 0.1N—NaOH by potentiometric titration using glass electrodes (according to JIS K1557-1970). In the case of a long-chain alkyl carboxylic acid, the titration is performed in a state of dissolution under heating.

In the case of a toner, a fraction thereof recovered by using a fraction collector during the molecular weight distribution measurement is used as a sample after drying and subjected to measurement in the above-described manner.

(5) Hydroxyl Value

A sample is accurately weighed into a 100 ml-eggplant-shaped flask, and 5 ml of an acetylating agent is accurately added thereto. Then, the system is heated by dipping into a bath of 100° C.±5° C. After 1–2 hours, the flask is taken out of the bath and allowed to cool by standing, and water is added thereto, followed by shaking to decompose acetic anhydride. In order to complete the decomposition, the flask is again heated for more than 10 min. by dipping into the bath. After cooling, the flask wall is sufficiently washed with an organic solvent. The resultant liquid is titrated with a N/2-potassium hydroxide solution in ethyl alcohol by potentiometric titration using glass electrodes (according to JIS K0070-1966). The OH value of a long-chain alkyl alcohol may be measured according to ASTM E-222, TEST METHOD B.

(6) Molecular Weight Distribution (for Resin or Resin Components)

The molecular weight (distribution) of a binder resin or resin component may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min., and 50–200 μl of a GPC sample solution adjusted at a concentration of 0.05–0.6 wt. % is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3$–$2\times10^6$. A preferred example thereof may be a combination of μ-styragel 500, $10^3$, $10^4$ and $10^5$ available from Waters Co.; or a combination of Shodex KA-801, 802, 803, 804 and 805 available from Showa Denko K.K.;

(7) Molecular Weight Distribution (for Long-Chain Alkyl Alcohol, Long-Chain Alkyl Carboxylic Acid)

The molecular weight (distribution) of a long-chain alkyl alcohol or a long-chain alkyl carboxylic acid may be measured by GPC under the following conditions:

Apparatus: "GPC-150C" (available from Waters Co.)

Column: "GMH-HT" 30 cm-binary (available from Toso K.K.)

Measurement temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and recalculated into a distribution corresponding to that of polyethylene using a conversion formula based on the Mark-Houwink viscosity formula.

(8) Toner Charge

Figure 2:
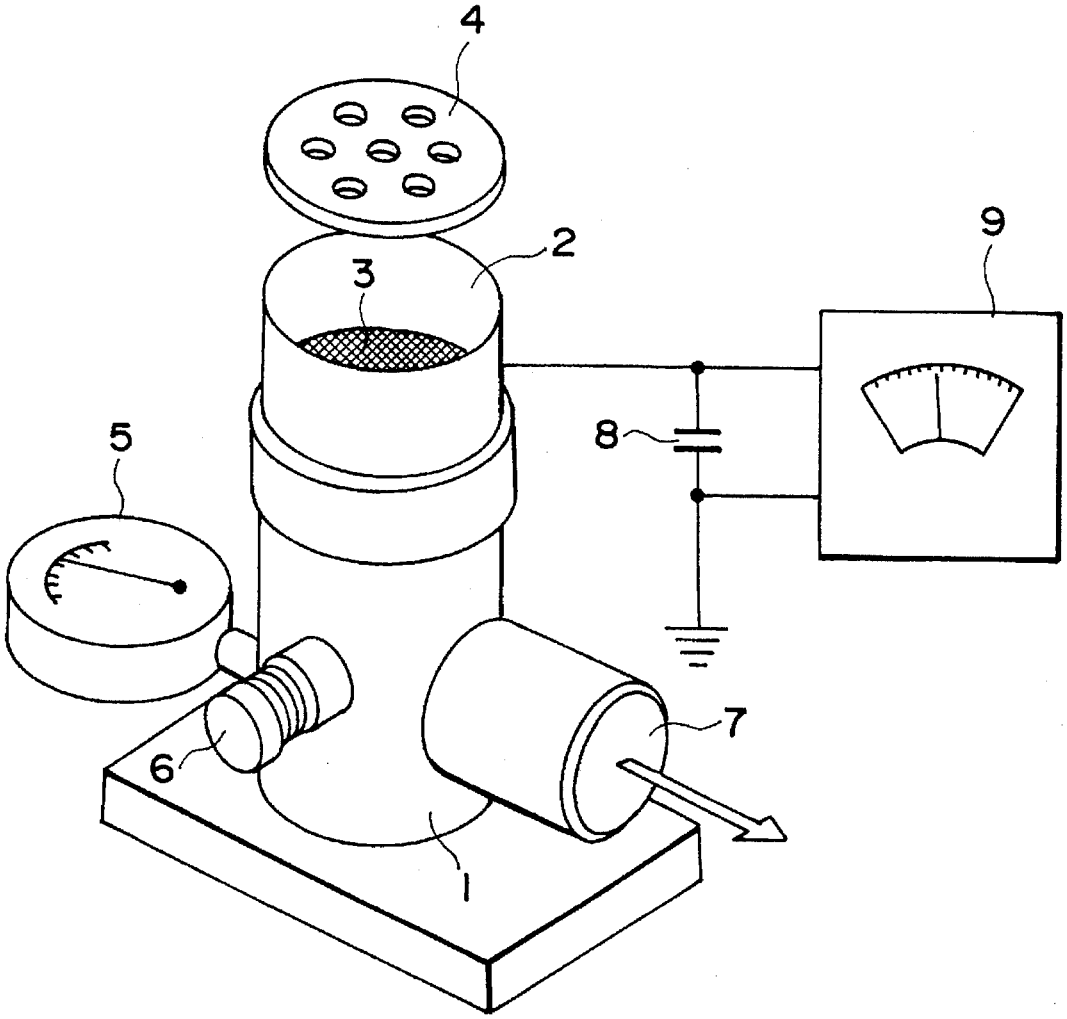
FIG. 2 is an illustration of an apparatus for measuring a triboelectric charge of a toner.

A developer sampled from a layer on a developer carrying member is weighed and placed in an apparatus as shown in FIG. 2, more specifically in a metal-made measuring container 2 equipped with an electroconductive screen of 500 mesh (capable of being changed into another size so as not to allow passage of magnetic carrier particles) at the bottom and covered with a metal lid 4. The total weight of the container 2 is weighed and denoted by $W_1$ (g). Then, an aspirator 1 composed of an insulating material at least with respect to a part contacting the container 2 is operated to suck the toner through a suction port 7 to set a pressure at a vacuum gauge 5 at 250 mm Ag while adjusting an aspiration control valve 6. In this state, the aspiration is performed sufficiently (for ca. 2 min.) to remove the toner. The reading at this time of a potential meter 9 connected to the container 2 via a capacitor 8 having a capacitance C (μF) is measured and denoted by V (volts). The total weight of the container after the aspiration is measured and denoted by $W_2$ (g). Then, the triboelectric charge T (μC/g) of the toner is calculated according to the following formula:

$$T(\mu C/g)=(C\times V)/(w_1-W_2).$$

(9) Content and Modification Ratio of Modified Polyester Resin (A) Sample Preparation Ca. 0.5 g of sample toner containing a principal resin component, a modified polyester resin, and a non-reacted long-chain alkyl alcohol or a long-chain alkyl carboxylic acid, is weighed and placed in a cylindrical filter paper (e.g., "No. 86R" having a size of 28 mm×100 mm, available from Toyo Roshi K.K.), and at least 500 ml of xylene heated to 120° C. or higher is dripped thereon. After the dripping, the xylene in the filtrate (solution of resinous matters including waxes, alcohols and carboxylic acid) is evaporated off, followed by drying under vacuum. Then, the thus-dried sample is weighed and placed again in a cylindrical filter paper to be placed on a Soxhlet's extractor (FIG. 3) and then subjected to extraction with 200 ml of solvent THF (tetrahydrofuran) in a Soxhlet's extractor. The extraction is performed for 6 hours. At this time, the reflux rate is controlled so that each THF extraction cycle takes about 4–5 minutes. After the extraction, the cylindrical filter paper is taken out and dried to recover the long-chain alkyl alcohol or carboxylic acid. The filtrate liquid is dried to recover the principal resin and the modified polyester resin in mixture.

Figure 3:
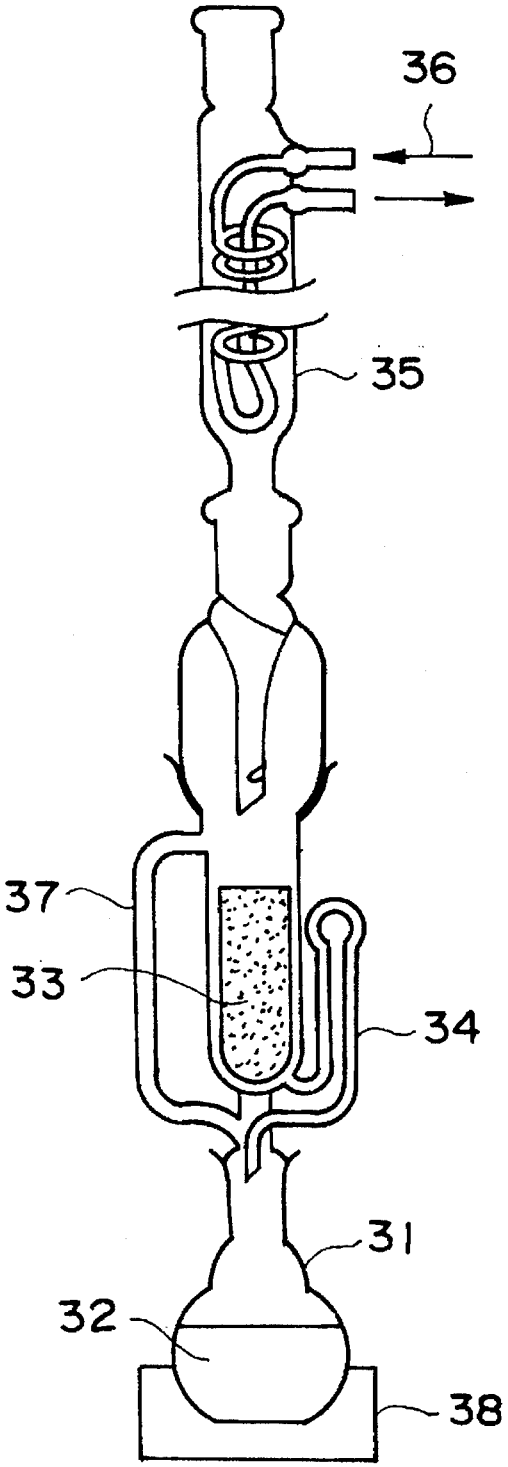
FIG. 3 is an illustration of a Soxhlet extractor.

Referring to FIG. 3 showing an exemplary Soxhlet's extractor, in operation, THF 32 contained in a vessel 31 is vaporized under heating by a heater 28, and the vaporized THF is caused to pass through a pipe 37 and guided to a cooler 35 which is always cooled with cooling water 36. The THF cooled in the cooler 35 is liquefied and stored in a reservoir part containing a cylindrical filter paper 33. Then, when the level of THF exceeds that in a middle pipe 34, the THF is discharged from the reservoir part to the vessel 31 through the pipe 34. During the operation, the toner or resin in the cylindrical filter paper is subjected to extraction with the thus circulating THF. (B) Content of modified polyester resin By DSC analysis (using, e.g., "DSC-7", available from Perkin-Elmer Corp.), heat absorption peaks are measured for the long-chain alkyl alcohol or long-chain alkyl carboxylic acid, and a mixture of the principal resin component and the modified polyester resin.

The measurement is performed according to ASTM D3418-42. Each sample is once subjected to temperature-raising to remove its thermal history and then subjected to the DSC analysis by effecting temperature raising and cooling in a temperature range of 0°–200° C. at a temperature-changing rate of 10 ° C./min. The area of a heat-absorption peak of each sample is divided by the sample weight to obtain ΔH (J/kg).

The content $C_R$ (%) of the modifier compound in the total resin components may be calculated according to the following equation:

$$C_R=(\Delta H_R/\Delta Ha)\times 100,$$

wherein $\Delta H_R$ denotes ΔH (J/kg) of the mixture of the principal resin component and the modified polyester resin, and a Ha denotes ΔH (J/kg) of the modifier compound per se (i.e., yet-unreacted) long-chain alkyl alcohol or long-chain alkyl carboxylic acid).

(C) Acid Value

A sample recovered in (9)(A) is used. Each sample is weighed and dissolved in a solvent, and water is added thereto. The resultant liquid is titrated with 0.1N—NaOH by potentiometric titration using glass electrodes (according to JIS K1557-1970). In the case of a long-chain alkyl carboxylic acid, the titration is performed in a dissolved state under heating. (D) OH Value A sample recovered in (9)(A) above is used for the measurement. Each sample is accurately weighed into a 100 ml-eggplant-shaped flask and 50 ml of xylene is added thereto, followed by heating on an oil bath at 120° C. Another eggplant-shaped flask containing 5 ml of xylene as a blank is equally subjected to the following operation.

After the dissolution, 5 ml of acetic anhydride/pyridine (=¼) mixture is added, followed by heating for at least 3 hours, adjustment of the oil bath temperature at 80° C., addition of a small amount of distilled water and standing for 2 hours. Then, after cooling by standing, the flask wall is sufficiently washed with a small amount of organic solvent. Phenolphthalein (dissolved in methanol) is added as an indicator, and the resultant liquid is titrated with a N/2 KOH/methanol solution according to potentiometric titration. The OH value of the sample is calculated according to the following equation:

$$\text{OH value}=28.05\times f\times(Tb-Ts)/S+A,$$

wherein the respective symbols denote the following.

S: sample amount (g),

Ts: a titration amount (ml) for the sample,

Tb: a titration amount (ml) for the blank,

A: acid value of the sample.

Hereinbelow, the present invention will be described with reference to Production Examples and Examples for evaluation of image forming performances.

EXAMPLE

Polyesters were prepared while monitoring the progress of the reaction by measuring the acid value and the reaction was terminated when a prescribed acid value was reached, followed by cooling to room temperature to recover the polyesters.

Polyester Production Example 1

| | |
|---|---|
| Terephthalic acid | 17 mol. % |
| Fumaric acid | 19 mol. % |
| Trimellitic anhydride | 16 mol. % |
| Bisphenol derivatives of the above-described formula (A), two types | |
| (R = propylene, x + y = 2.2) | 30 mol. % |
| (R = ethylene, x + y = 2.2) | 18 mol. % |

The above ingredients were subjected to polycondensation to obtain a non-linear high-softening point polyester resin having a softening point of 130 ° C. (called "High-softening point polyester resin C").

Polyester Production Example 2

| | |
|---|---|
| Isophthalic acid | 28 mol. % |
| Adipic acid | 20 mol. % |
| Bisphenol derivatives of the above-described formula (A), two types | |
| (R = propylene, x + y = 2.2) | 17 mol. % |
| (R = ethylene, x + +y = 2.2) | 35 mol. % |

The above ingredients were subjected to polycondensation to obtain a linear low-softening point polyester resin having a softening point of 93 ° C. (called "Low-softening point polyester resin A").

Polyester Production Example 3

| | |
|---|---|
| Terephthalic acid | 20 mol. % |
| Fumaric acid | 18 mol. % |
| Trimellitic anhydride | 10 mol. % |
| Bisphenol derivatives of the above-described formula (A), two types | |
| (R = propylene, x + y = 2.2) | 17 mol. % |
| (R = ethylene, x + y = 2.2) | 35 mol. % |

The above ingredients were subjected to polycondensation to obtain a non-linear low-softening point polyester resin having a softening point of 99° C. (called "Low-softening point polyester resin B").

Polyester Production Examples 4–19

Polyester resins D–V were prepared by subjecting monomers respectively shown in Table 1 to polycondensation similarly as in Polyester Production Example 1, and the softening points of the resultants polyester resins are also shown in Table 1 below.

TABLE 1

| Polyester resin | | Monomer composition*3 | Softening point |
|---|---|---|---|
| Type*1 | Name | (acids//alcohols) | (°C.) |
| L | A | IPA/AA//PO-BPA/EO-BPA | 93 |
| L | D*2 | AA/DSA//PO-BPA/EO-BPA | 71 |
| L | E*2 | TPA//PO-BPA/EO-BPA | 75 |
| NL | B | TPA/FA/TMA//PO-BPA/EO-BPA | 99 |

TABLE 1-continued

| Polyester resin Type*1 | Name | Monomer composition*3 (acids//alcohols) | Softening point (°C.) |
|---|---|---|---|
| NL | F*2 | AA/SA/TMA//PO-BPA/EO-BPA | 78 |
| NL | G | IPA/TMA//PO-BPA/EO-BPA | 122 |
| NL | C | IPA/TPA/TMA//PO-BPA/EO-BPA | 130 |
| NL | H | TPA/TMA/PO-BPA/EO-BPA | 119 |
| NL | I*2 | TPA//PO-BPA/PET/PO-NPR | 186 |
| NL | J | IPA/TPA/TMA//PO-BPA/EO-BPA | 123 |
| NL | K | IPA/TPA//PO-BPA/PET/PO-NPR | 178 |
| NL | L | AA/TMA//PO-BPA/EO-BPA | 83 |
| NL | M | FA/TMA//PO-BPA/EO-BPA | 118 |
| L | N | TPA/IPA/DSA//PO-BPA/PO-NPR/EO-NPR | 126 |
| L | O | TPA/AA/DSA//PO-BPA/PO-NPR/EO-NPR | 109 |
| L | P | TPA/IPA/SA//PO-BPA/PO-NPR/EO-NPR | 106 |
| NL | Q | IPA/DSA/TMA-BTCA//PO-BPA/EO-BPA | 98 |
| NL | R | IPA/DSA/TMA-BTCA/PO-BPA/EO-BPA | 96 |
| L | S*2 | TAP/AA/SA//PO-BPA/PO-NPR/EO-NPR | 77 |
| NL | T | IPA/TPA/FA//PO-BPA/PET/PO-NPR | 183 |
| L | U*2 | AA/SA//PO-BPA/PO-NPR/EO-NPR | 73 |
| NL | V | SA/DSA/TMA/BTCA//PO-BPA/EO-BPA | 123 |

Notes:
*1: L denotes a linear polyester.
NL denotes a non-linear polyester.
*2: Represents a comparative polyester resin.
*3: The monomers (acids and alcohols).

Notes

*1: L denotes a linear polyester NL denotes a non-linear polyester

*2: represents a comparative polyester resin

*3: The monomers (acids and alcohols) are represented by abbreviative symbols respectively as follows:

TPA: terephthalic acid
FA: fumaric acid
TMA: trimellitic anhydride
AA: adipic acid
IPA: isophthalic acid
SA: succinic acid
DSA: dodecenylsuccinic acid
BTCA: benzophenonetetracarboxylic acid
PO-BPA: bisphenol derivative of the formula (A) (R=propylene)
EO-BPA: bisphenol derivative of the formula (A) (R=ethylene)
PET: pentaerythritol
PO-NPR: propylene oxide-added novolak-type phenolic resin
EO-NPR: ethylene oxide-added novolak-type phenolic resin Polyester Resin Composition Production Example 1

| | |
|---|---|
| Polyester resin C | 50 wt. parts |
| Polyester resin A | 50 wt. parts |

The above resins were blended by a Henschel mixer to obtain a polyester resin composition (i) having an acid value=35, OH value=25, Tg=60° C., Mn=4000, and Mw=247,000.

Polyester Resin Composition Production Example 2

Into polyester resin B melted at an elevated temperature, an identical weight of polyester resin C was added and mixed under stirring, followed by cooling, to provide a resin composition (ii) having an acid value=22, OH value=14, Tg=63° C., Mn=4500, and Mw=270,000.

Polyester Resin Composition Production Examples 3–20

Resin compositions (iii) to (xx) shown in Table 2 were prepared in the same manner as above.

Long-Chain Alkyl and Carboxylic Acid

Long-chain alkyl alcohols α-1 to α-9 and long-chain alkyl carboxylic acids Bβ-1 to β-6 characterized by the parameters shown in Table 3 were used for preparation of toners.

TABLE 2

| Resin composition | Nonlinear polyester (I) | s.p. (°C.) | Linear or nonlinear polyester (II) | s.p. (°C.) | Acid value (mgKOH/g) | OH value (mgKOH/g) | Tg (°C.) | Molecular weight Mn | Mw | Mw/Mn |
|---|---|---|---|---|---|---|---|---|---|---|
| (i) | C | 130 | A | 93 | 35 | 25 | 60 | 4000 | 247,000 | 62 |
| (ii) | C | 130 | B | 99 | 22 | 14 | 63 | 4500 | 270,000 | 60 |
| (iii)* | C | 130 | D | 71 | 41 | 28 | 57 | 3200 | 97,000 | 30 |
| (iv)* | C | 130 | E | 75 | 17 | 15 | 64 | 4700 | 136,000 | 29 |
| (v)* | C | 130 | F | 78 | 40 | 25 | 58 | 3700 | 79,000 | 21 |
| (vi)* | C | 130 | G | 122 | 18 | 18 | 63 | 5200 | 130,000 | 25 |
| (vii) | H | 119 | A | 93 | 38 | 28 | 59 | 4200 | 84,000 | 20 |
| (viii) | I | 186 | A | 93 | 15 | 23 | 61 | 5300 | 134,000 | 25 |
| (ix) | C | 130 | L | 83 | 36 | 20 | 58 | 4000 | 240,000 | 60 |
| (x) | C | 130 | M | 118 | 19 | 20 | 62 | 4800 | 269,000 | 56 |
| (xi) | J | 123 | B | 99 | 20 | 12 | 62 | 4300 | 267,000 | 62 |
| (xii) | K | 178 | B | 99 | 17 | 20 | 62 | 5100 | 323,000 | 63 |
| (xiii) | N | 126 | O | 109 | 6 | 58 | 57 | 4000 | 290,000 | 73 |
| (xiv) | N | 126 | P | 106 | 3 | 64 | 58 | 4100 | 285,000 | 69 |
| (xv) | C | 130 | Q | 98 | 56 | 13 | 60 | 4300 | 252,000 | 59 |
| (xvi) | C | 130 | R | 96 | 65 | 12 | 60 | 4100 | 248,000 | 60 |
| (xvii)* | N | 126 | S | 77 | 3 | 76 | 57 | 4200 | 63,000 | 15 |
| (xviii)* | T | 183 | P | 106 | 2 | 52 | 58 | 4200 | 122,000 | 29 |

TABLE 2-continued

| Resin composition | Nonlinear polyester (I) | | Linear or nonlinear polyester (II) | | Acid value | OH value | Tg | Molecular weight | | |
|---|---|---|---|---|---|---|---|---|---|---|
| | | s.p. (°C.) | | s.p. (°C.) | (mgKOH/g) | (mgKOH/g) | (°C.) | Mn | Mw | Mw/Mn |
| (xix)* | N | 126 | U | 73 | 11 | 84 | 57 | 4100 | 94,000 | 23 |
| (xx)* | C | 130 | V | 123 | 84 | 14 | 57 | 3900 | 76,000 | 19 |

*: Resin composition followed by * is a comparative one.

TABLE 3

| Long-chain alkyl alcohol or carboxylic acid | OH value or acid value | X or Y | Molecular weight Mn | Mw | Mw/Mn | Melting point (°C.) | Content*2 (wt. %) |
|---|---|---|---|---|---|---|---|
| α-1 | 70 | 48 | 440 | 870 | 2.0 | 108 | 60 |
| α-2 | 90 | 38 | 280 | 800 | 2.9 | 100 | 58 |
| α-3 | 12 | 170 | 1,800 | 3,900 | 2.2 | 115 | 96 |
| α-4 | 28 | 120 | 1,600 | 7,700 | 4.8 | 105 | 92 |
| α-5 | 65 | 52 | 620 | 2,000 | 3.2 | 110 | 57 |
| α-6 | 98 | 38 | 230 | 580 | 2.5 | 98 | 58 |
| α-7 | 118 | 36 | 170 | 780 | 4.6 | 92 | 50 |
| α-8 *1 | 155 | 18 | 140 | 370 | 2.6 | 75 | 25 |
| α-9 *1 | 1 | 320 | 4,100 | 11,000 | 2.7 | 165 | 99 |
| β-1 | 90 | 38 | 300 | 820 | 2.7 | 105 | 58 |
| β-2 | 22 | 140 | 1,600 | 3,000 | 1.9 | 140 | 95 |
| β-3 *1 | 3 | 270 | 2,600 | 7,800 | 3.0 | 145 | 90 |
| β-4 *1 | 125 | 19 | 250 | 520 | 2.1 | 92 | 27 |
| β-5 | 8 | 198 | 2,100 | 4,500 | 2.1 | 127 | 85 |
| β-6 | 115 | 37 | 310 | 860 | 2.8 | 96 | 62 |

Notes to Table 3

*1: Long-chain alkyl alcohol (α-1 to α-9) or carboxylic alcohol (β-1 to β-6) followed by *1 is a comparative compound.

*2: The values represent the contents of long-chain alkyl alkyl alcohol components of at least 37 carbon atoms ($\geqq C_{37}$) or long-chain alkyl carboxylic alcohol components of at least 38 carbon atoms ($\geqq C_{38}$). Regarding the contents of the long-chain alkyl compounds, the following should be noted.

(1) The long-chain alkyl alcohols α-1 to α-7 all contained at least 70 wt. % of long-chain alkyl alcohol components having long-chain alkyl groups of 23 to 252 carbon atoms.

(2) The long-chain alkyl carboxylic acids β-2, β-5 and β-6 all contained at least 70 wt. % of long-chain alkyl carboxylic acid components having long-chain alkyl groups of 22 to 251 carbon atoms.

(3) The long-chain alkyl alcohol α-8 contained less than 30 wt. % of the long-chain alkyl alcohol components, and the long-chain alkyl alkyl alcohol α-9 contained less than 10 wt. % of the long-chain alkyl alcohol components.

(4) The long-chain alkyl carboxylic acids β-3 and β-4 respectively contained less than 10 wt. % of the long-chain alkyl carboxylic acid components.

Example 1

| | |
|---|---|
| Polyester resin composition (i) | 100 wt. parts |
| Magnetic iron oxide (average particle size (Dav.) = 0.15 μm, Hc = 115 oersted, $\sigma_s$ = 80 emu/g, $\sigma_r$ = 11 emu/g) | 90 wt. parts |
| Long-chain alkyl alcohol (α-1) of Formula (1) ($x_{av.}$ = 48, OH value = 70, Mn = 440, Mw = 870, Mw/Mn = 2.0, m.p. = 108° C., alcohol ($\geqq C_{37}$) content = 60 wt. %) | 5 wt. parts |
| Mono-azo metal complex (negative charge control agent) | 2 wt. parts |

The above ingredients were pre-mixed by a Henschel mixer and melt-kneaded through a twin-screw extruder at 130° C. After cooling, the melt-kneaded product was coarsely crushed by a cutter mill and finely pulverized by a jet stream pulverizer, followed by classification by a pneumatic classifier to obtain a magnetic toner having a weight average particle size of 6.3 μm. To 100 wt. parts of the magnetic toner, 1.0 wt. part of hydrophobic dry-process silica (BET specific surface area ($S_{BET}$)=300 $m_2$/g) was externally added to obtain a magnetic toner, the characterizing data of which are shown in Tables 4 and 5.

The magnetic toner was charged into a digital copying machine ("GP-55", mfd. by Canon K.K.) to be evaluated with respect image characteristics, whereby results as shown in Table 6 appearing hereinafter were obtained. Further, a fixing test was performed by taking out the fixing apparatus of the copying machine so as to use it as an externally driven fixing apparatus equipped with a temperature controller at various fixing speeds, whereby good results also as shown in Table 6 were obtained.

As for the image characteristic evaluation the density gradation characteristic was good because of a fast charging speed and a stable saturation charge. Accompanying this, an undesirable phenomenon of selective development that a developer fraction of a small particle size is selectively consumed could be obviated. The halftone images were free from change in image quality from the initial stage, free from density irregularity, smooth and good.

The resultant toner showed a developing potential—copy image density characteristic as represented by a dot and dash line in FIG. 1.

Examples 2–24

Magnetic toners were prepared and evaluated in the same manner as in Example 1 except that the polyester resin composition, long-chain alkyl alcohol and long-chain alkyl carboxylic acid were changed as shown in Tables 4–5, whereby results as shown in Table 6 were obtained.

Table 6 shows the results of evaluation performed according to the following manner and standards.

(1) Each item was evaluated at 5 levels as follows:

o: good, oΔ: rather good,

Δ: average,

Δx: rather poor x: poor.

(2) The solid-black maximum image density (IDmax) was measured by a densitometer ("Macbeth RD-918", available from Macbeth Co. )

(3) Density gradation (gray scale).

An original including solid-black images having image densities at 4 levels of 0.4, 0.6, 1.0 and 1.5. The image densities of copy images were measured, and the evaluation was performed according to the following measures based on the comparison between original densities and copy image densities. The indicated evaluation result was given when all the conditions were satisfied, otherwise a lower evaluation result was given.

| Evaluation | Original Density | Copy image density |
|---|---|---|
| o | 1.5 | 1.40–below 1.60 |
| | 1.0 | 1.0 ± 0.1 |
| | 0.6 | 0.6 ± 0.15 |
| | 0.4 | 0.4 ± 0.2 |
| oΔ | 1.5 | 1.35–below 1.40 |
| | 1.0 | 1.0 ± 0.15 |
| | 0.6 | 0.6 ± 0.20 |
| | 0.4 | 0.4 ± 0.25 |
| Δ | 1.5 | 1.25–below 1.35 |
| | 1.0 | 1.0 ± 0.20 |
| | 0.6 | 0.6 ± 0.25 |
| | 0.4 | 0.4 ± 0.30 |
| Δx | 1.5 | 1.18–below 1.25 |
| | 1.0 | 1.0 ± 0.25 |
| | 0.6 | 0.6 ± 0.30 |
| | 0.4 | 0.4 ± 0.35 |
| x | 1.5 | below 1.18 |
| | 1.0 | 1.0 ± 0.30 |
| | 0.6 | 0.6 ± 0.35 |
| | 0.4 | 0.4 ± 0.35 |

(4) Halftone image quality (reproducibility) was evaluated by forming an image at an image density of ca. 0.4–0.8 and comparing the image with standard samples by eye observation.

(5) Line scattering was evaluated by comparison with standard samples by eye observation.

(6) P.S. change

The PS (particle size) change of a toner before and after a continuous image formation was evaluated in the following manner.

A developing device is charged with a fresh developer (magnetic toner) and subjected to blank rotation of the developing sleeve and developer stirrer to apply the magnetic toner onto the developing sleeve. Then, the rotation is stopped, and an overhead projector (OHP) sheet is pressed onto the toner coating layer to recover a sample of the fresh toner.

After a continuous image formation, a toner sample on the developing sleeve is similarly recovered.

Each toner sample is subjected to a particle size distribution measurement in following manner.

Coulter Multisizer II (available from Coulter Electronics Inc.) is used as an instrument for measurement, to which are connected an interface (available from Nikkaki K.K.) for providing a number-basis distribution and a volume-basis distribution, and a personal computer ("CX-1", available from Canon K.K.).

For measurement, a 1%-NaCl aqueous solution as an electrolytic solution is prepared by using a reagent-grade sodium chloride. Into 100 to 150 ml of the electrolytic solution, 0.1 to 5 ml of a surfactant (preferably an alkylbenzenesulfonic acid salt) is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution by using the above-mentioned Coulter Multisizer II with a 100 micron-aperture to obtain a volume-basis distribution and a number-basis distribution. From the results of the volume-basis distribution and number-basis distribution, a weight-average particle size of the toner sample is calculated.

(7) Triboelectricity on a sleeve

The triboelectric charge of a toner (magnetic toner) on a developing sleeve was measured by using a suction-type Faraday cage in the following manner.

An outer cylinder of the Faraday cage is pushed against a developing sleeve to recover by sucking the magnetic toner on a certain area of the developing sleeve on a filter of the inner cylinder, so that the sucked toner sample weight is calculated from the weight increase of the filter. At the same time, the amount of charge accumulated at the inner cylinder electrostatically isolated from the exterior member to obtain the charged electricity of the magnetic toner on the developing sleeve.

(8) E.S. (Environmental Stability) is evaluated collectively based on image qualities formed in a high temperature/high humidity environment (30° C./85%) environment after standing for 24 hours.

(9) Fixability

After obtaining a developing potential (V)-copy image density (D) relationship as shown in FIG. 1, yet-unfixed images with a maximum copy density and a copy density of 0.5 are obtained by using the remodelled copying machine ("GP-55", described above) used in Examples and subjected to fixation at various fixing temperatures by using the externally driven fixing device. The evaluation is performed in the following manner.

(a) Solid-black (maximum image density) part

The image density (Di max) of each fixed image is measured and then the fixed image is rubbed ten times with two sheets of lens cleaning paper ("dasper (R)", available from Ozu Paper Co. Ltd.) under a weight of 200 g to measure the image density after rubbing (Dm max). A temperature giving an image density decrease dv max by rubbing as defined by the following formula of at most 10% is defined as a fixing initiation temperature $T_{FI}$.

$$dv\ max=100\times(1-Dm\ max/Di\ max)$$

The evaluation standards are given as follows as a result of fixation at fixing speeds of 50 mm/sec and 500 mm/sec based on the fixing initiation temperatures $T_{FI}$ (°C.).

| Evaluation | $T_{FI}$ at fixing speeds of 50 mm/sec | $T_{FI}$ at fixing speeds of 500 mm/sec |
|---|---|---|
| o | below 135° C. | below 170° C. |
| oΔ | 135° C.–below 150° C. | 170° C.–below 180° C. |
| Δ | 150° C.–below 165° C. | 180° C.–below 190° C. |
| Δx | 165° C.–below 180° C. | 190° C.–below 200° C. |
| x | ≧180° C. | ≧200° C. |

(b) Halftone image (D=0.5)

Each fixed halftone image is subjected to the same rubbing test as the solid black part. The density decrease (dv H.T.) by rubbing at the halftone part is defined as follows, $$dv\ H.T.=100\times(1-Dm\ H.T./Di\ H.T.),$$

wherein Di H.T. and Dm H.T. denote the image densities at the halftone part before and after the rubbing respectively.

The fixing test is performed at the fixing speeds of 50 mm/sec and 500 mm/sec an the evaluation is performed according to the same standards as follows.

| Evaluation | Standards |
|---|---|
| o | dv H.T. ≦ 20% |
| oΔ | 20% < dv H.T. ≦ 30% |
| Δ | 30% < dv H.T. ≦ 40% |
| Δx | 40% < dv H.T. ≦ 50% |
| x | 50% < dv H.T. |

(10). High-temperature offset (Tos).

Solid black yet-unfixed images are used for fixing at a fixing speed of 50 mm./sec and at gradually increasing fixing temperatures to find an offset-initiation temperature Tos by preliminarily cleaning the fixing roller and observing the staining of the roller by offset with eyes. The evaluation is performed according to the following standards based on the offset initiation temperature.

| Evaluation | Offset initiation temperature Tos |
|---|---|
| o | Tos ≧ 200° C. |
| oΔ | 190° C. Tos < 200° C. |
| Δ | 180° C. ≦ Tos < 190° C. |
| Δx | 170° C. ≦ Tos < 180° C. |
| x | Tos < 170° C. |

(11) Anti-blocking characteristic 100 g of a toner sample is weighed into a 100 ml-plastic cup and left standing in a hot air drier at 50° C. for 1 week. After the standing, the flowability of the toner sample is evaluated by eye observation at five levels of o (best), oΔ, Δ, Δx, x (worst).

TABLE 4

| | Polyester components (I) | | Polyester components (II) | | Polyester composition 100 wt. parts (a) | | | Long-chain alkyl compound (alcohol or carboxylic acid) | | | Formula (I)*1 | | |
|---|---|---|---|---|---|---|---|---|---|---|---|---|---|
| Example | Name | SP (°C.) | Name | SP (°C.) | No. | Acid value | OH value | Type | Amount (wt. parts) | OH or acid value | (S) left side | (P) right side | (S)–(P) |
| 1 | C | 130 | A | 93 | (i) | 35 | 25 | α-1 | 5 | 70 | 105 | 6.2 | +98.8 |
| 2 | C | 130 | B | 99 | (ii) | 22 | 14 | α-1 | 5 | 70 | 92 | 3.5 | +88.5 |
| 3 | C | 130 | B | 99 | (ii) | 22 | 14 | β-1 | 5 | 90 | 112 | 3.5 | +108.5 |
| 4 | C | 130 | L | 83 | (ix) | 36 | 20 | α-1 | 5 | 70 | 106 | 5 | +101 |
| 5 | C | 130 | M | 118 | (x) | 19 | 20 | α-1 | 5 | 70 | 89 | 5 | +84 |
| 6 | J | 123 | B | 99 | (xi) | 20 | 12 | α-1 | 5 | 70 | 90 | 3 | +87 |
| 7 | K | 178 | B | 99 | (xii) | 17 | 20 | α-1 | 5 | 70 | 87 | 5 | +82 |
| 8 | C | 130 | B | 99 | (ii) | 22 | 14 | α-1 | 5 | 70 | 182 | 3.5 | +178.5 |
| | | | | | | | | β-1 | 5 | 90 | | | |
| 9 | C | 130 | B | 99 | (ii) | 3 | 14 | α-1 | 3 | 70 | 92 | 3.5 | +88.5 |
| | | | | | | | | γ*2 | 3 | 0 | | | |
| 10*3 | C | 130 | B | 99 | (ii) | 22 | 14 | α-1 | 22 | 70 | 92 | 3.5 | +88.5 |
| 11 | C | 130 | B | 99 | (ii) | 22 | 14 | α-1 | 0.3 | 70 | 92 | 3.5 | +88.5 |
| 12 | N | 126 | O | 109 | (xiii) | 6 | 58 | α-1 | 5 | 70 | 76 | 14.5 | +61.5 |
| 13 | N | 126 | P | 106 | (xiv) | 3 | 64 | α-1 | 5 | 70 | 73 | 16 | +57 |
| 14 | C | 130 | Q | 98 | (xv) | 56 | 13 | α-1 | 5 | 70 | 126 | 3.2 | +122.8 |
| 15 | C | 130 | R | 96 | (xvi) | 65 | 12 | α-1 | 5 | 70 | 135 | 3 | +132 |
| 16 | C | 130 | B | 99 | (ii) | 22 | 14 | α-2 | 5 | 90 | 112 | 3.5 | +108.5 |
| 17 | C | 130 | B | 99 | (ii) | 22 | 14 | α-3 | 5 | 12 | 34 | 3.5 | +30.5 |
| 18 | C | 130 | B | 99 | (ii) | 22 | 14 | α-4 | 5 | 28 | 50 | 3.5 | +46.5 |
| 19 | C | 130 | B | 99 | (ii) | 22 | 14 | α-5 | 5 | 65 | 87 | 3.5 | +83.5 |
| 20 | C | 130 | B | 99 | (ii) | 22 | 14 | α-6 | 5 | 98 | 120 | 3.5 | +116.5 |
| 21 | C | 130 | B | 99 | (ii) | 22 | 14 | α-7 | 5 | 118 | 140 | 3.5 | +136.5 |
| 22 | C | 130 | B | 99 | (ii) | 22 | 14 | β-2 | 5 | 22 | 44 | 3.5 | +40.5 |
| 23 | C | 130 | B | 99 | (ii) | 22 | 14 | β-5 | 5 | 8 | 30 | 3.5 | +26.5 |
| 24 | C | 130 | B | 99 | (ii) | 22 | 14 | β-6 | 5 | 115 | 137 | 3.5 | +133.5 |

Notes to Table 4

*1: (S) (left side of the above-mentioned formula [I]) represents [Acid value of the polyester resin composition+OH value of the long-chain alkyl alcohol+Acid value of long-chain alkyl carboxylic acid].

(P) (right side of the formula [I]) represents (¼)×OH value of the polyester resin composition.

*2: γ represents a low-molecular weight ethylenepropylene copolymer (polymerized under a low pressure in the presence of a Ziegler catalyst) having a molecular weight of 700.

*3: The composition showed a somewhat inferior pulverizability during toner production.

TABLE 5

| | Polyester resin composition in toner | | | |
|---|---|---|---|---|
| Example | Mw | Mn | Mw/Mn | Content of M.W. ≧2 × $10^5$ (%) |
| 1 | 238000 | 3900 | 61.0 | 9.0 |
| 2 | 265000 | 4400 | 60.2 | 13.0 |
| 3 | 260000 | 4300 | 60.5 | 12.0 |
| 4 | 227000 | 3800 | 59.7 | 9.8 |
| 5 | 265000 | 4200 | 63.1 | 15.0 |
| 6 | 258000 | 4000 | 64.5 | 8.5 |
| 7 | 320000 | 4800 | 66.7 | 18.0 |
| 8 | 268000 | 4400 | 60.9 | 13.2 |
| 9 | 267000 | 4400 | 60.7 | 13.0 |

TABLE 5-continued

| | Polyester resin composition in toner | | | |
|---|---|---|---|---|
| Example | Mw | Mn | Mw/Mn | Content of M.W. ≧2 × $10^5$ (%) |
| 10 | 268000 | 4300 | 62.3 | 11.5 |
| 11 | 259000 | 4100 | 63.2 | 9.5 |
| 12 | 275000 | 3700 | 74.3 | 11.0 |
| 13 | 278000 | 4000 | 69.5 | 11.7 |
| 14 | 243000 | 4100 | 59.3 | 8.5 |
| 15 | 229000 | 3700 | 61.9 | 7.0 |
| 16 | 260000 | 4300 | 60.5 | 11.5 |
| 17 | 262000 | 4400 | 59.5 | 12.0 |
| 18 | 260000 | 4200 | 61.9 | 11.7 |
| 19 | 263000 | 4300 | 61.2 | 10.8 |
| 20 | 258000 | 4000 | 64.5 | 9.2 |
| 21 | 26000 | 4200 | 61.9 | 10.0 |
| 22 | 267000 | 4300 | 62.1 | 13.2 |
| 23 | 260000 | 4100 | 63.4 | 10.5 |
| 24 | 262000 | 4200 | 62.4 | 9.8 |

TABLE 6

| | Image characteristics (GP-55) | | | | | | | | | | | |
|---|---|---|---|---|---|---|---|---|---|---|---|---|
| | Initial | | | | | | After 2 × $10^4$ sheets | | | | | |
| | | | | Line | | | | | | | | |
| Ex. | Dmax | Gradation | Halftone | scatter | Dav. (μm) | Charge (μC/g) | Dmax | Gradation | Halftone | Dav. (μm) | Charge (μC/g) | E.S. |
| 1 | ○ 1.47 | ○ | ○ | ○ | 6.3 | −17.1 | ○ 1.47 | ○ | ○ | 6.5 | −16.9 | ○ |
| 2 | ○ 1.48 | ○ | ○ | ○ | 6.2 | −17.6 | ○ 1.48 | ○ | ○ | 6.4 | −17.1 | ○ |
| 3 | ○ 1.48 | ○ | ○ | ○ | 6.4 | −16.8 | ○ 1.47 | ○ | ○ | 6.5 | −16.7 | ○ |
| 4 | ○ 1.48 | ○ | ○ | ○ | 6.3 | −17.3 | ○ 1.48 | ○ | ○ | 6.4 | −16.9 | ○ |
| 5 | ○ 1.47 | ○ | ○ | ○ | 6.4 | −17.2 | ○ 1.48 | ○ | ○ | 6.5 | −16.8 | ○ |
| 6 | ○ 1.46 | ○ | ○ | ○ | 6.3 | −17.3 | ○ 1.48 | ○ | ○ | 6.6 | −16.9 | ○ |
| 7 | ○ 1.42 | ○ | ○Δ | ○Δ | 6.3 | −16.7 | ○ 1.43 | ○ | ○Δ | 6.6 | −16.6 | ○Δ |
| 8 | ○ 1.45 | ○ | ○ | ○ | 6.2 | −17.6 | ○ 1.42 | ○ | ○ | 6.7 | −16.9 | ○ |
| 9 | ○ 1.45 | ○ | ○ | ○ | 6.3 | −17.3 | ○ 1.43 | ○ | ○Δ | 6.6 | −16.8 | ○ |
| 10 | ○ 1.45 | ○ | ○ | ○ | 6.3 | −18.0 | ○ 1.45 | ○ | ○ | 6.6 | −17.8 | ○Δ |
| 11 | ○Δ 1.37 | ○Δ | ○ | ○ | 6.3 | −16.1 | ○ 1.46 | ○ | ○Δ | 6.6 | −17.3 | ○Δ |
| 12 | ○ 1.45 | ○ | ○Δ | ○ | 6.4 | −15.7 | ○ 1.45 | ○ | ○Δ | 6.8 | −17.1 | ○Δ |
| 13 | ○ 1.45 | ○ | ○Δ | ○ | 6.5 | −15.5 | ○ 1.45 | ○ | ○Δ | 6.9 | −16.8 | ○Δ |
| 14 | ○ 1.44 | ○ | ○ | ○ | 6.4 | −17.1 | ○ 1.46 | ○ | ○ | 6.7 | −17.0 | ○Δ |
| 15 | ○ 1.45 | ○ | ○ | ○ | 6.4 | −17.2 | ○ 1.46 | ○ | ○ | 6.9 | −17.1 | ○Δ |
| 16 | ○ 1.45 | ○ | ○ | ○ | 6.6 | −15.9 | ○ 1.46 | ○ | ○ | 7.0 | −15.3 | ○ |

TABLE 6-continued

| | | | | | | | | | | | | |
|---|---|---|---|---|---|---|---|---|---|---|---|---|
| 17 | ○ 1.40 | ○ | ○ | ○Δ | 6.5 | −15.1 | ○ 1.40 | ○ | ○ | 6.9 | −14.7 | ○Δ |
| 18 | ○ 1.45 | ○ | ○ | ○Δ | 6.5 | −12.4 | ○ 1.40 | ○ | ○ | 6.9 | −11.6 | ○Δ |
| 19 | ○ 1.41 | ○ | ○ | ○ | 6.6 | −14.8 | ○ 1.42 | ○ | ○ | 6.9 | −14.9 | ○Δ |
| 20 | ○ 1.45 | ○ | ○ | ○ | 6.5 | −14.9 | ○ 1.45 | ○ | ○ | 6.9 | −14.9 | ○Δ |
| 21 | ○Δ 1.37 | ○Δ | ○ | ○Δ | 6.7 | −13.8 | ○Δ 1.36 | ○Δ | Δ | 7.2 | −13.6 | ○Δ |
| 22 | ○ 1.41 | ○ | ○ | ○ | 6.8 | −13.9 | ○ 1.41 | ○Δ | ○ | 7.3 | −13.9 | ○Δ |
| 23 | ○Δ 1.38 | ○Δ | ○ | ○ | 6.9 | −13.3 | ○Δ 1.37 | ○Δ | ○Δ | 7.6 | −13.1 | ○Δ |
| 24 | ○ 1.43 | ○ | ○ | ○ | 6.8 | −15.6 | ○ | ○ | ○ | 6.9 | −15.4 | ○ |

| | Fixability | | | | | |
|---|---|---|---|---|---|---|
| | 50 mm/sec | | 500 mm/sec | | | |
| | Solid black (Dmax) | Half-tone | Solid black (Dmax) | Half-tone | Anti- | |
| Ex. | $T_{FI}$ | (D = 0.5) | $T_{FI}$ | (D = 0.5) | offset | block |
| 1 | ○ 130° C. | ○ | ○ 165° C. | ○ | ○ | ○ |
| 2 | ○ 130° C. | ○ | ○ 165° C. | ○ | ○ | ○ |
| 3 | ○ 130° C. | ○ | ○ 165° C. | ○ | ○ | ○ |
| 4 | ○ 130° C. | ○ | ○ 165° C. | ○ | ○ | ○Δ |
| 5 | ○Δ 137° C. | ○Δ | ○Δ 173° C. | ○Δ | ○ | ○ |
| 6 | ○ 130° C. | ○ | ○ | ○ | ○Δ | ○ |
| 7 | ○Δ 138° C. | ○Δ | ○Δ 175° C. | ○Δ | ○ | ○ |
| 8 | ○ 130° C. | ○ | ○ 165° C. | ○ | ○ | ○ |
| 9 | ○ 130° C. | ○ | ○ 165° C. | ○ | ○ | ○ |
| 10 | ○ 128° C. | ○ | ○ 165° C. | ○ | ○ | ○Δ |
| 11 | ○ 133° C. | ○ | ○ 170° C. | ○ | ○ | ○ |
| 12 | ○ 130° C. | ○ | ○ 165° C. | ○ | ○ | ○ |
| 13 | ○ 130° C. | ○ | ○ 165° C. | ○ | ○ | ○ |
| 14 | ○ 130° C. | ○ | ○ 165° C. | ○ | ○ | ○ |
| 15 | ○ 130° C. | ○ | ○ 165° C. | ○ | ○ | ○ |
| 16 | ○ 130° C. | ○ | ○ 165° C. | ○ | ○ | ○ |
| 17 | ○Δ 137° C. | ○Δ | ○Δ 175° C. | ○Δ | ○ | ○ |
| 18 | ○ 130° C. | ○ | ○ 170° C. | ○ | ○ | ○ |
| 19 | ○ 130° C. | ○ | ○ 165° C. | ○ | ○ | ○ |
| 20 | ○ 130° C. | ○Δ | ○ 165° C. | ○ | ○ | ○ |
| 21 | ○Δ 130° C. | ○ | ○Δ 165° C. | ○Δ | ○ | ○ |
| 22 | ○ 140° C. | ○ | ○Δ 175° C. | ○Δ | ○ | ○ |
| 23 | ○ 145° C. | ○ | ○Δ 175° C. | ○Δ | ○ | ○ |
| 24 | ○ 130° C. | ○ | ○ 165° C. | ○ | ○ | ○Δ |

Comparative Examples 1–16

Magnetic toners having characteristics shown in Tables 8 and 9 were prepared in the same manner as in Example 1 except for replacing the polyester resin composition, the long-chain alkyl alcohol and the long-chain alkyl carboxylic acid with those shown in Table 7. The resultant magnetic toners were evaluated in the same manner as in Example 1, whereby results shown in Table 10 were obtained.

TABLE 7

| | Polyester components | | | | Polyester composition | | | Long-chain alkyl compound (alcohol or carboxylic acid) | | | Formula (I)*1 | | |
|---|---|---|---|---|---|---|---|---|---|---|---|---|---|
| | (I) | | (II) | | 100 wt. parts (a) | | | | | | | | |
| Comparative Example | Name | SP (°C.) | Name | SP (°C.) | No. | Acid value | OH value | Type | Amount (wt. parts) | OH or acid value | (S) left side | (P) right side | (S)–(P) |
| 1 | C | 130 | D | 71 | (iii) | 41 | 28 | α-1 | 5 | 70 | 111 | 7 | +104 |
| 2 | C | 130 | E | 75 | (iv) | 17 | 15 | α-1 | 5 | 70 | 87 | 3.7 | +83.3 |
| 3 | C | 130 | F | 78 | (v) | 40 | 25 | α-1 | 5 | 70 | 110 | 6.2 | +103.8 |
| 4 | C | 130 | G | 122 | (vi) | 18 | 18 | α-1 | 5 | 70 | 88 | 4.5 | +83.5 |
| 5 | H | 119 | A | 93 | (vii) | 38 | 28 | α-1 | 5 | 70 | 108 | 7 | +101 |
| 6 | I | 186 | A | 93 | (viii) | 15 | 23 | α-1 | 5 | 70 | 85 | 5.7 | +79.3 |
| 7 | C | 130 | A | 93 | (i) | 35 | 25 | γ*2 | 5 | 0 | 35 | 6.2 | +28.8 |
| 8 | N | 126 | S | 77 | (xvii) | 3 | 76 | α-3 | 5 | 12 | 15 | 19 | −4 |
| 9 | C | 130 | A | 93 | (i) | 35 | 25 | — | — | — | 35 | 6.2 | +28.8 |
| 10 | T | 183 | P | 106 | (xviii) | 2 | 52 | α-1 | 5 | 70 | 72 | 13 | +59 |
| 11 | C | 130 | V | 123 | (xx) | 84 | 14 | α-1 | 5 | 70 | 154 | 3.5 | +150.5 |
| 12 | N | 126 | U | 73 | (xix) | 11 | 84 | α-1 | 5 | 70 | 81 | 21 | +60 |
| 13 | C | 130 | B | 99 | (ii) | 22 | 14 | α-8 | 5 | 155 | 177 | 3.5 | +173.5 |
| 14 | C | 130 | B | 99 | (ii) | 22 | 14 | β-3 | 5 | 3 | 25 | 3.5 | +21.5 |
| 15 | C | 130 | B | 99 | (ii) | 22 | 14 | β-4 | 5 | 125 | 147 | 3.5 | +143.5 |
| 16 | C | 130 | B | 99 | (ii) | 22 | 14 | α-9 | 5 | 1 | 23 | 3.5 | +19.5 |

*1, *2: The same as in Table 4.

TABLE 8

| | Polyester resin composition in toner | | | |
|---|---|---|---|---|
| Example | Mw | Mn | Mw/Mn | Content of M.W. ≧ $2 \times 10^5$ (%) |
| 1 | 90000 | 2800 | 32.1 | 0.5 |
| 2 | 128000 | 4500 | 28.4 | 2.0 |
| 3 | 70000 | 3300 | 21.2 | 0.2 |
| 4 | 121000 | 4800 | 25.2 | 3.2 |
| 5 | 79000 | 4000 | 19.8 | 0.2 |
| 6 | 129000 | 5000 | 25.8 | 3.6 |
| 7 | 228000 | 3300 | 69.1 | 7.5 |
| 8 | 59000 | 3800 | 15.5 | 0.1 |
| 9 | 213000 | 3000 | 71.0 | 6.8 |
| 10 | 110000 | 3700 | 29.7 | 2.7 |
| 11 | 65000 | 3400 | 19.1 | 0.1 |
| 12 | 87000 | 3700 | 23.5 | 0.2 |
| 13 | 258000 | 4200 | 61.4 | 8.8 |
| 14 | 262000 | 4300 | 60.9 | 11.2 |
| 15 | 259000 | 4100 | 63.2 | 9.2 |
| 16 | 263000 | 4400 | 59.8 | 12.2 |

TABLE 9

| Comp. Ex. | Image characteristics (GP-55) Initial Dmax | Grada-tion | Half-tone | Line scat-ter | Dav. (μm) | Charge (μC/g) | After 2 × 10⁴ sheets Dmax | Grada-tion | Half-tone | Dav. (μm) | Charge (μC/g) | E.S. | Fixability 50 mm/sec Solid black (Dmax) $T_{FI}$ | Half-tone (D = 0.5) | 500 mm/sec Solid black (Dmax) $T_{FI}$ | Half-tone (D = 0.5) | Anti-offset | Anti-block |
|---|---|---|---|---|---|---|---|---|---|---|---|---|---|---|---|---|---|---|
| 1 | ○ 1.43 | ○ | ○ | ○ | 6.5 | −16.8 | ○ 1.40 | ○ | ○ | 6.9 | −16.2 | ○ | ○ 130° C. | ○ | ○ 165° C. | ○ | ○ | x |
| 2 | ○ 1.44 | ○ | ○ | ○ | 6.4 | −16.7 | ○ 1.41 | ○ | ○ | 6.8 | −16.2 | ○ | Δ 165° C. | Δx | Δx 195° C. | x | ○ | ○ |
| 3 | ○ 1.47 | ○ | ○ | ○ | 6.4 | −16.9 | ○ 1.44 | ○ | ○ | 6.8 | −16.3 | ○ | ○ 133° C. | ○ | ○ 165° C. | ○ | ○ | x |
| 4 | ○ 1.43 | ○ | ○ | ○ | 6.3 | −16.8 | ○ 1.40 | ○ | ○ | 6.7 | −16.3 | ○ | Δx 165° C. | Δx | Δx 195° C. | x | ○ | ○ |
| 5 | ○ 1.43 | ○ | ○ | ○ | 6.4 | −16.7 | ○ 1.40 | ○ | ○ | 6.8 | −16.2 | ○ | ○ 130° C. | ○ | ○ 165° C. | ○ | x | ○ |
| 6 | Δx | Δx | Δx | Δx | 6.8 | −11.2 | Δx | Δx | Δx | 9.2 | −10.0 | Δx | Δx | x | x | x | ○ | ○ |
| 7 | ○ 1.43 | ○ | Δ | ○Δ | 6.5 | −16.4 | Δx 1.27 | x | x | 8.5 | −13.7 | x | Δ 155° C. | x | Δx 190° C. | x | ○ | ○ |
| 8 | Δx 1.24 | x | Δ | Δ | 6.3 | −14.1 | Δx 1.23 | Δx | Δx | 7.6 | −12.7 | Δx | ○Δ 135° C. | ○ | ○Δ 170° C. | ○ | ○ | ○ |
| 9 | ○ 1.42 | ○Δ | Δ | Δ | 6.6 | −16.2 | Δx 1.18 | x | x | 8.3 | −13.4 | x | ○Δ 145° C. | x | Δ 190° C. | x | Δ | ○ |
| 10 | x 1.17 | x | Δx | Δx | 6.6 | −11.3 | Δx 1.23 | Δx | Δx | 7.7 | −13.9 | ○ | ○Δ 145° C. | ○ | ○Δ 170° C. | ○ | ○ | ○ |
| 11 | ○ 1.45 | ○ | ○ | ○ | 6.5 | −16.6 | Δx 1.26 | x | x | 8.3 | −13.2 | x | ○ 130° C. | ○ | ○ 165° C. | ○ | ○ | ○ |
| 12 | ○ 1.46 | ○ | ○ | ○ | 6.6 | −17.1 | Δx 1.23 | x | x | 8.2 | −12.6 | x | ○ 130° C. | ○ | ○ 165° C. | ○ | ○ | ○ |
| 13 | x 1.07 | x | x | x | 6.5 | −11.8 | | ** (see below) | | | | x | ○ 135° C. | ○ | ○ 170° C. | ○ | ○ | x |
| 14 | x 1.09 | x | Δx | Δx | 6.5 | −14.3 | Δx 1.26 | Δ | Δ | 7.9 | −13.8 | Δx | ○ 130° C. | ○ | ○ 165° C. | ○ | ○ | ○ |
| 15 | ○ 1.43 | ○ | ○ | ○ | 6.6 | −16.8 | | ** (see below) | | | | x | ○ 130° C. | ○ | ○ 165° C. | ○ | ○ | x |
| 16 | Δx 1.23 | Δ | Δ | Δ | 6.6 | −14.3 | Δx 1.27 | Δ | Δ | 7.9 | −13.9 | Δx | ○ 130° C. | ○ | ○ 165° C. | ○ | ○ | ○ |

**: Melt-sticking onto the photosensitive member so that the image formation could not be continued up to $2 \times 10^4$ sheets.

Polyester Resin Production Example 20

| | |
|---|---|
| Terephthalic acid | 17 mol. % |
| Isophthalic acid | 19 mol. % |
| Trimellitic anhydride | 16 mol. % |
| Bisphenol derivatives of the above-described formula (A) | |
| (R = propylene, x + y = 2.2) | 30 mol. % |
| (R = ethylene, x + y = 2.2) | 18 mol. % |

The above ingredients were subjected to polycondensation to obtain a polyester resin A-2 having a softening point of 140° C.

Polyester Resin Production Examples 21 and 22

Polycondensation was repeated in a similar manner as in the above polyester resin Production Example while changing the ingredients to prepare Polyester Resins B-2 and C-2 as shown in Table 10.

Polyester Resin Production Example 23

| | |
|---|---|
| Terephthalic acid | 20 mol. % |
| Isophthalic acid | 18 mol. % |
| Trimellitic anhydride | 10 mol. % |
| Bisphenol derivatives of the above-described formula (A) | |
| (R = propylene, x + y = 2.2) | 17 mol. % |
| (R = ethylene, x + y = 2.2) | 35 mol. % |

The above ingredients were subjected to polycondensation to obtain a polyester resin D-2 having a softening point of 99° C.

Polyester Resin Production Examples 24 and 25

Polycondensation was repeated in a similar manner as in the above polyester resin Production Example while changing the ingredients to prepare Polyester Resins E-2 and F-2 as shown in Table 10.

Production Example 26 (modified polyester resin composition)

| | |
|---|---|
| Terephthalic acid | 100 wt. parts |
| Dodecenylsuccinic acid | 75 wt. parts |
| Trimellitic anhydride | 70 wt. parts |
| Bisphenol deviative of the formula (A) (R = propylene, x + y = 2.2) | 360 wt. parts |
| Alkyl alcohol of the following formula $CH_3(CH_2)_xCH_2OH$ ($x_{av}$ = 48, OH value = 70, Mn = 440, Mw = 870, m.p. = 180° C.; denoted by α-1 in Table 11) | 150 wt. parts |

The above ingredients were subjected to polycondensation accompanied with modification to obtain a modified polyester resin G-2 shown in Table 12.

Production Examples 27–33 (Modified Polyester Resin Compositions)

Modified polyester resins H-2 to L2 and N-2 shown in Table 12 were prepared by polycondensation and modification in the same manner as in Production Example 26 except for using long-chain alkyl alcohols α10 to α-14 and long-chain alkyl carboxylic acid instead of the long-chain alkyl alcohol α-1.

Production Example 34 (Modified Polyester Resin Composition)

| | |
|---|---|
| Polyester resin A-2 (prepared in Production Example 20) | 75 wt. parts |
| Alkyl alcohol of the following formula $CH_3(CH_2)_xCH_2OH$ ($x_{av}$ = 48, OH value = 70, Mn = 440, Mw = 870, m.p. = 108° C., α-1 in Table 11) | 25 wt. parts |

The above ingredients were melted under heating and subjected to a modification reaction under a reduced pressure to obtain a modified polyester resin M-2 shown in Table 12.

TABLE 10

| Polyester resin | Monomer composition (acids//alcohols) | Softening point |
|---|---|---|
| A-2 | TPA/IPA/TMA//PO-BPA/EO-BPA | 140 (°C.) |
| B-2 | TPA/FA/TMA//PO-BPA/EO-BPA | 123 |
| C-2 | TPA/DSA/TMA//PO-BPA/EO-BPA | 165 |
| D-2 | TPA/FA/TMA//PO-BPA/EO-BPA | 99 |
| E-2 | TPA/FA/TMA//PO-BPA/EO-BPA | 83 |
| F-2 | IPA/AA/TMA//PO-BPA/EO-BPA | 113 |

TABLE 11

| Alkyl alcohol or carboxylic acid | OH value or acid value | X or Y | Molecular weight Mn | Molecular weight Mw | m.p. (°C.) |
|---|---|---|---|---|---|
| α-1 | 70 | 48 | 440 | 870 | 108 |
| -10 | 90 | 22 | 280 | 800 | 100 |
| -11 | 9 | 99 | 2300 | 4300 | 135 |
| -12 | 28 | 80 | 1600 | 8700 | 105 |
| -13 | 98 | 38 | 230 | 580 | 98 |
| -14 | 122 | 28 | 240 | 530 | 80 |
| β-1 | 90 | 38 | 300 | 820 | 105 |

α-1 and 10–14: long-chain alkyl alcohol
β-1: long-chain alkyl carboxylic acid

TABLE 12

| Modified polyester resin composition | Modified polyester resin content (wt. %) | Non-reacted polyester resin content (wt. %) | Non-reacted alcohol or carboxylic acid content (wt. %) |
|---|---|---|---|
| G-2 | 50.0 | 40.0 | 10.0 |
| H-2 | 63.0 | 30.0 | 7.0 |
| I-2 | 9.0 | 75.0 | 16.0 |
| J-2 | 11.0 | 76.0 | 13.0 |
| K-2 | 67.0 | 28.0 | 5.0 |
| L-2 | 73.0 | 25.0 | 2.0 |
| M-2 | 10.0 | 76.0 | 14.0 |
| N-2 | 57.0 | 35.0 | 8.0 |

Production Example 35 (Polyester Resin Composition)

| | |
|---|---|
| Polyester resin A-2 | 40 wt. parts |
| Polyester resin D-2 | 40 wt. parts |
| Modified polyester resin G-2 | 20 wt. parts |

The above resins were blended by a Henschel mixer to obtain a polyester resin composition (xxi) having Mn=35,000, Mw=200,000, and Tg=58° C.

Production Example 36 (Polyester Resin Composition

Into polyester resin B-2 melted at an elevated temperature, an identical weight of polyester resin D-2 was added and mixed under stirring, followed by cooling, to prepare a resin, which was then blended with polyester resin G-2 to obtain a polyester resin composition having Mn=4000, Mw=500,000 and Tg=63 ° C.

Production Examples 37–55 (Polyester Resin Composition)

Resin compositions (xxiii) to (xxxi) shown in Table 13 were prepared in the same manner as above.

TABLE 13

| | Resin composition | | | | Tg | Molecular weight | | Modified*2 polyester |
|---|---|---|---|---|---|---|---|---|
| No. | Polyester (I) | Polyester (II) | Polyester (III)*1 | | (°C.) | Mn | Mw | content (%) |
| xxi | A-2 | D-2 | G-2 | (α-1) | 58 | 4,000 | 200,000 | 5 |
| xxii | B-2 | D-2 | G-2 | (α-1) | 63 | 3,500 | 500,000 | 10 |
| xxiii | C-2 | D-2 | H-2 | (α-10) | 65 | 5,500 | 800,000 | 7 |
| xxiv | A-2 | E-2 | H-2 | (α-10) | 54 | 2,500 | 150,000 | 12 |
| xxv | A-2 | F-2 | G-2 | (α-1) | 50 | 1,800 | 130,000 | 3 |
| xxvi | A-2 | D-2 | I-2 | (α-11) | 69 | 5,000 | 500,000 | 0.5 |
| xxvii | A-2 | D-2 | J-2 | (α-12) | 62 | 7,000 | 1,000,000 | 20 |
| xxviii | B-2 | H-2 | K-2 | (α-13) | 44 | 1,400 | 210,000 | 25 |
| xxix | C-2 | G-2 | L-2 | (α-14) | 72 | 12,000 | 1,600,000 | 0.1 |
| xxx | A-2 | DF-2 | M-2 | (α-1) | 59 | 3,800 | 260,000 | 2.5 |
| xxxi | A-2 | DF-2 | N-2 | (β-1) | 61 | 4,400 | 290,000 | 3 |

*1: Alkyl alcohols or alkyl monocarboxylic acids used are shown in parentheses.
*2: The content of a modified polyester resin in a resin composition.

Example 25

| | |
|---|---|
| Polyester resin composition (xxi) | 100 wt. parts |
| Magnetic iron oxide (Dav. = 0.15 μm, Hc = 115 oersted, $\sigma_s$ = 80 emu/g, $\sigma_r$ = 11 emu/g) | 90 wt. parts |
| Mono-azo metal complex (negative charge control agent) | 2 wt. parts |

The above ingredients were pre-mixed by a Henschel mixer and melt-kneaded through a twin-screw extruder at 130° C. After cooling, the melt-kneaded product was coarsely crushed by a cutter mill and finely pulverized by a jet stream pulverizer, followed by classification by a pneumatic classifier to obtain a magnetic toner having a weight-average particle size of 6.3 μm. To 100 wt. parts of the magnetic toner, 1.0 wt. part of hydrophobic dry-process silica (BET specific surface area ($S_{BET}$)=300 $m^2/g$) was externally added to obtain a magnetic toner.

The magnetic toner was charged into a digital copying machine ("GP-55", mfd. by Canon K.K.) to be evaluated with respect image characteristics, whereby good results as shown in Table 15 appearing hereinafter were obtained. Further, a fixing test was performed by taking out the fixing apparatus of the copying machine so as to use it as an externally driven fixing apparatus equipped with a temperature controller at various fixing speeds, whereby good results also as shown in Table 15 were obtained.

Examples 26–35

Magnetic toners were prepared in the same d in the same manner as in Example 25 except that the polyester resin compositions (xxii)–(xxxi) were used instead of the resin composition (xxi), whereby results as shown in Table 15 were obtained.

Example 36

A magnetic toner was prepared in the same manner as in Example 25 except for using 30 wt. parts of the classified fine powder fraction in addition to 100 wt. parts of the polyester resin composition (xxi), 90 wt. parts of the magnetic iron oxide and 2 wt. parts of the mono-azo metal complex. The magnetic toner was evaluated in the same manner as in Example 25, whereby results shown in Table 15 were obtained.

TABLE 14

| | Polyester resin composition in toner | | | |
|---|---|---|---|---|
| Example | Mw | Mn | Mw/Mn | Content of M.W. ≧ $2 \times 10^5$ (%) |
| 25 | 198000 | 3300 | 60.0 | 7.3 |
| 26 | 475000 | 3900 | 124.4 | 15.8 |
| 27 | 755000 | 5300 | 142.5 | 20.0 |
| 28 | 147000 | 2400 | 61.3 | 6.5 |
| 29 | 128000 | 1700 | 75.3 | 5.7 |
| 30 | 480000 | 4700 | 102.1 | 16.5 |
| 31 | 943000 | 5800 | 162.6 | 22.5 |
| 32 | 195000 | 1400 | 139.3 | 10.3 |
| 33 | 118000 | 6800 | 173.5 | 28.8 |
| 34 | 245000 | 3500 | 70.0 | 14.0 |
| 35 | 270000 | 4000 | 67.5 | 17.5 |
| 36 | 197000 | 3300 | 59.7 | 7.0 |

TABLE 15

| | Image characteristic | | | | | | | | Fixability (50 mm/sec) | | | |
|---|---|---|---|---|---|---|---|---|---|---|---|---|
| | Initial | | | After 5 × $10^4$ sheets | | | | | Solid black | | | |
| Ex. | Dmax | Gradation | Halftone | Dmax | Gradation | Halftone | Cleaning | E.S. | (Dmax) $T_{FI}$ | Halftone (D = 0.5) | Anti-offset | Anti-block |
| 25 | ○ 1.48 | ○ | ○ | ○ 1.48 | ○ | ○ | ○ | ○ | ○ 120° C. | ○ | ○ | ○ |
| 26 | ○ 1.48 | ○ | ○ | ○ 1.48 | ○ | ○ | ○ | ○ | ○ 120° C. | ○ | ○ | ○ |
| 27 | ○ 1.47 | ○Δ | ○Δ | ○ 1.48 | ○Δ | ○Δ | ○Δ | ○ | ○ 125° C. | ○ | ○Δ | ○Δ |
| 28 | ○ 1.47 | ○ | ○ | ○ 1.47 | ○ | ○ | ○Δ | ○ | ○ 120° C. | ○ | ○Δ | ○ |
| 29 | ○ 1.47 | ○ | ○ | ○ 1.47 | ○ | ○ | ○ | ○ | ○ 130° C. | ○ | ○Δ | ○Δ |
| 30 | ○ 1.47 | ○ | ○ | ○ 1.47 | ○ | ○ | ○ | ○ | ○ 130° C. | ○ | ○ | ○ |
| 31 | ○ 1.47 | ○ | ○ | ○ 1.47 | ○ | ○ | ○ | ○ | ○ 130° C. | ○ | ○ | ○ |
| 32 | ○ 1.42 | ○ | ○ | ○ 1.42 | ○ | ○Δ | ○ | ○ | ○ 130° C. | ○ | ○Δ | ○ |
| 33 | ○ 1.42 | ○ | ○ | ○ 1.42 | ○Δ | ○Δ | ○ | ○ | ○ 130° C. | ○Δ | ○Δ | ○Δ |
| 34 | ○ 1.46 | ○ | ○ | ○ 1.46 | ○ | ○ | ○ | ○ | ○ 125° C. | ○ | ○ | ○ |
| 35 | ○ 1.48 | ○ | ○ | ○ 1.48 | ○ | ○ | ○ | ○ | ○ 130° C. | ○ | ○ | ○ |
| 36 | ○ 1.48 | ○ | ○ | ○ 1.48 | ○ | ○ | ○Δ | ○ | ○ 125° C. | ○ | ○ | ○ |

What is claimed is:

1. A toner for developing an electrostatic image, comprising: a resin composition and a colorant, wherein said resin composition comprises (i) a high-softening point polyester resin (I) having a softening point of 120°–180° C., (ii) a low-softening point polyester resin (II) having a softening point of 80° C.–120° C. (exclusive), and (iii) a long-chain alkyl compound selected from the group consisting of (a) a long-chain alkyl alcohol having the formula of $$CH_3(CH_2)_xCH_2OH$$

wherein x denotes an average value in the range of 21–250, and (b) a long-chain alkyl carboxylic acid having the formula of $$CH_3(CH_2)_yCOOH$$

wherein y denotes an average value in the range of 21–250, and said long-chain alkyl compound is contained in 0.1–30 wt. parts per 100 wt. parts of the resin composition.

2. The toner according to claim 1, wherein said high-softening point polyester resin (I) has a softening point of 125°–175° C.

3. The toner according to claim 1 or 2, wherein said low-softening point polyester resin (II) has a softening point of 85°–115° C.

4. The toner according to claim 1, wherein said high-softening point polyester resin (I) has a softening point which is higher by at least 10° C. than that of said low-softening point polyester resin (II).

5. The toner according to claim 4, wherein said high-softening point polyester resin (I) has a softening point which is higher by at least 20° C. than that of said low-softening point polyester resin (II).

6. The toner according to claim 1, wherein said high-softening point polyester resin (I) is a non-linear polyester resin, and said low-softening point polyester resin (II) is a non-linear polyester resin.

7. The toner according to claim 1, wherein said high-softening point polyester resin (I) is a non-linear polyester resin, and said low-softening point polyester resin (II) is a linear polyester resin.

8. The toner according to claim 1, wherein x is 21–100.

9. The toner according to claim 1, wherein said long-chain alkyl alcohol has a weight-average molecular weight (Mw) of 500–10,000 and a ratio (Mw/Mn) of Mw to a number-average molecular weight (Mn) of at most 3.

10. The toner according to claim 9, wherein said long-chain alkyl alcohol has Mw of 600–8000 and Mw/Mn of at most 2.5.

11. The toner according to claim 1, wherein said long-chain alkyl alcohol contain at least 50 wt. % of long-chain alkyl alcohol components of at least 37 carbon atoms.

12. The toner according to claim 1, wherein said long-chain alkyl alcohol has an OH value of 10–120 mgKOH/g.

13. The toner according to claim 12, wherein said long-chain alkyl alcohol has an OH value of 20–100 mgKOH/g.

14. The toner according to claim 1, wherein said long-chain alkyl compound has a melting point of at least 91° C.

15. The toner according to claim 1, wherein y is 21–100.

16. The toner according to claim 1, wherein said long-chain alkyl carboxylic acid has a weight-average molecular weight (Mw) of 500–10,000 and a ratio (Mw/Mn) of Mw to a number-average molecular weight (Mn) of at most 3.

17. The toner according to claim 16, wherein said long-chain alkyl carboxylic acid has Mw of 600–8000 and Mw/Mn of at most 2.5.

18. The toner according to claim 1, wherein said long-chain alkyl carboxylic acid contain at least 50 wt. % of long-chain alkyl carboxylic acid components of at least 38 carbon atoms.

19. The toner according to claim 1, wherein said long-chain alkyl carboxylic acid has an acid value of 5–120 mgKOH/g.

20. The toner according to claim 19, wherein said long-chain alkyl carboxylic acid has an acid value of 10–100 mgKOH/g.

21. The toner according to claim 1, wherein said long-chain alkyl compound is contained in 0.5–20 wt. parts per 100 wt. parts of the resin composition.

22. The toner according to claim 1, wherein said resin composition has $Mw=3\times10^3-3\times10^6$ and $Mn=10^3-5\times10^4$.

23. The toner according to claim 23, wherein said resin composition has $Mw=10^4-2.5\times10^6$ and $Mn=1.5\times10^3-2\times10^4$.

24. The toner according to claim 23, wherein said resin composition has $Mw=4\times10^4-2\times10^6$ and $Mn=2.5\times10^3-1\times10^4$.

25. The toner according to claim 1, wherein said resin composition has an acid value of 2.5–80 mgKOH/g.

26. The toner according to claim 25, wherein said resin composition has an acid value of 5–60 mgKOH/g.

27. The toner according to claim 26, wherein said resin composition has an acid value of 10–50 mgKOH/g.

28. The toner according to claim 1, wherein said resin composition has an OH value of at most 80 mgKOH/g.

29. The toner according to claim 1, wherein said resin composition further contains a polyester resin (III), at least a portion of which has been modified with a compound having a long-chain alkyl group of 23 to 102 carbon atoms and a terminal hydroxyl or carboxyl group.

30. The toner according to claim 29, wherein said polyester resin (III) has been modified with a long-chain alkyl alcohol of the formula:

$$CH_3(CH_2)_xCH_2OH,$$

wherein x denotes an average value of 21–100.

31. The-toner according to claim 29, wherein said polyester resin (III) has been modified with a long-chain alkyl carboxylic acid of the formula:

$$CH_3(CH_2)_xCOOH,$$

wherein y denotes an average value of 21–100.

32. A toner for developing an electrostatic image, comprising: a resin composition and a colorant, said resin composition comprising a polyester resin and a long-chain alkyl compound selected from the group consisting of (a) a long-chain alkyl alcohol having the formula of $$CH_3(CH_2)_xCH_2OH$$

wherein x denotes an average value in the range of 21–250, and (b) a long-chain alkyl carboxylic acid having the formula of $$CH_3(CH_2)_yCOOH$$

wherein y denotes an average value in the range of 21–250, wherein said long-chain alkyl compound is contained in 0.1–30 wt. parts per 100 wt. parts of the resin composition, and said resin composition includes a tetrahydrofuran (THF)-soluble content providing a gel permeation chromatogram showing a weight average molecular weight (Mw) of at least $10^5$, a ratio of Mw to number-average molecular weight (Mn) of at least 35, and an areal percentage of at least 5% of a region of molecular weight of at least $2\times10^5$.

33. The toner according to claim 32, wherein x is 21–100.

34. The toner according to claim 32, wherein said long-chain alkyl alcohol has a weight-average molecular weight (Mw) of 500–10,000 and a ratio (Mw/Mn) of Mw to a number-average molecular weight (Mn) of at most 3.

35. The toner according to claim 34 wherein said long-chain alkyl alcohol has Mw of 600–8000 and Mw/Mn of at most 2.5.

36. The toner according to claim 32, wherein said long-chain alkyl alcohol contain at least 50 wt. % of long-chain alkyl alcohol components of at least 37 carbon atoms.

37. The toner according to claim 32, wherein said long-chain alkyl alcohol has an OH value of 10–120 mgKOH/g.

38. The toner according to claim 37, wherein said long-chain alkyl alcohol has an OH value of 20–100 mgKOH/g.

39. The toner according to claim 32, wherein said long-chain alkyl compound has a melting point of at least 91° C.

40. The toner according to claim 32, wherein y is 21–100.

41. The toner according to claim 32, wherein said long-chain alkyl carboxylic acid has a weight-average molecular weight (Mw) of 500–10,000 and a ratio (Mw/Mn) of Mw to a number-average molecular weight (Mn) of at most 3.

42. The toner according to claim 41, wherein said long-chain alkyl carboxylic acid has Mw of 600–8000 and Mw/Mn of at most 2.5.

43. The toner according to claim 32, wherein said long-chain alkyl carboxylic acid contain at least 50 wt. % of long-chain alkyl carboxylic acid components of at least 38 carbon atoms.

44. The toner according to claim 43, wherein said long-chain alkyl carboxylic acid has an acid value of 5–120 mgKOH/g.

45. The toner according to claim 44, wherein said long-chain alkyl carboxylic acid has an acid value of 5–100 mgKOH/g.

46. The toner according to claim 32, wherein said long-chain alkyl compound is contained in 0.5–20 wt. parts per 100 wt. parts of the resin composition.

47. The toner according to claim 32, wherein said resin composition has an acid value of 2.5–80 mgKOH/g.

48. The toner according to claim 47, wherein said resin composition has an acid value of 5–60 mgKOH/g.

49. The toner according to claim 48, wherein said resin composition has an acid value of 10–50 mgKOH/g.

50. The toner according to claim 32, wherein said resin composition has an OH value of at most 80 mgKOH/g.

* * * * *

UNITED STATES PATENT AND TRADEMARK OFFICE

CERTIFICATE OF CORRECTION

PATENT NO. : 5,660,963

DATED : August 26, 1997

INVENTOR(S): TADASHI DOUJO ET AL.

It is certified that error appears in the above-identified patent and that said Letters Patent is hereby corrected as shown below:

ON THE TITLE PAGE, AT [57], IN THE ABSTRACT

Line 7, "of-a" should read -- of a--.

COLUMN 1

Line 10, "electro-photographic" should read --electrophotographic--;

Line 30, "toner-image" should read --toner image--.

COLUMN 2

Line 7, "images" should read --images,--;

Line 41, "part" should read --parts--;

Line 42, "collapsion" should read --collapse--;

Line 51, "lack toner" should read --lack of toner--;

Line 55, "improved" should read --improved,--.

COLUMN 3

Line 17, "excepted" should read --expected--.

COLUMN 4

Line 12, "of" should read --by--;

Line 17, "from" should read --from a--;

Line 65, "0H" should read --OH--.

COLUMN 5

Line 51, "tone" should read --toner--;

Line 63, "to" should read --to a--.

UNITED STATES PATENT AND TRADEMARK OFFICE

CERTIFICATE OF CORRECTION

PATENT NO. : 5,660,963

DATED : August 26, 1997

INVENTOR(S): TADASHI DOUJO ET AL.

It is certified that error appears in the above-identified patent and that said Letters Patent is hereby corrected as shown below:

COLUMN 6

Line 11, "composition-comprising" should read --composition comprising--.

COLUMN 7

Line 19, "O=C=O" should read --O-----C-----O--;

Line 28, "associated two" should read--two associated--;

Line 48, "intoner" should read --in toner--.

COLUMN 8

Line 36, "nols" should read --nol--.

COLUMN 9

Line 23, ",2,7,8-" should read --2,7,8---.

COLUMN 12

Line 1, "group" should read --groups--.

COLUMN 13

Line 11, "produced" should read --produced by--.

COLUMN 14

Line 4, "nection" should read --nections--;

Line 22, "is attained to result in a difficulty" should read --occurs, which eliminates difficulties,--;

Line 43, "aklyl" should read --alkyl group--.

UNITED STATES PATENT AND TRADEMARK OFFICE

CERTIFICATE OF CORRECTION

PATENT NO. : 5,660,963

DATED : August 26, 1997

INVENTOR(S): TADASHI DOUJO ET AL.

It is certified that error appears in the above-identified patent and that said Letters Patent is hereby corrected as shown below:

COLUMN 15

Line 12, "wt." should read --wt. %--;

Line 63, "low temperature-fixability" should read --low-temperature fixability--.

COLUMN 16

Line 33, "image" should read --images--.

COLUMN 17

Line 47, "formation. The" should read --formation, the--.

COLUMN 18

Line 15, " 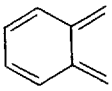 " should read -- 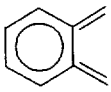 --;

Line 57, "-bisolerylamide" should read --bisoleylamide--.

COLUMN 19

Line 61, "pyrolyric" should read --pyrolytic--.

COLUMN 20

Line 7, "powder" should read --powders--;

Line 45, "benzyldimethylcholrosilane" should read --benzodimethylchlorosilane--.

COLUMN 21

Line 21, "in" should read --in a--.

UNITED STATES PATENT AND TRADEMARK OFFICE

CERTIFICATE OF CORRECTION

PATENT NO. : 5,660,963

DATED : August 26, 1997

INVENTOR(S): TADASHI DOUJO ET AL.

It is certified that error appears in the above-identified patent and that said Letters Patent is hereby corrected as shown below:

COLUMN 22
Line 30, "Tq" should read --Tg--;
Line 54, "m.p" should read --m.p.--;
Line 67, "mixture solvent" should read --solvent mixture--.

COLUMN 24
Line 24, "mmAg" should read --mm Hg--;
Line 34, "$w_1$" should read --$W_1$--;
Line 58, "in mixture" should read --in the mixture--.

COLUMN 25
Line 3, "(B)" should read --¶ (B)--;
Line 26, "yet-unreacted)" should read --yet unreacted--;
Line 35, "(D)" should read --¶ (D)--;
Line 65, "EXAMPLE" should read --EXAMPLES--.

COLUMN 26
Line 66, "resultants" should read --resultant--.

COLUMN 27
Line 22, lines 22-26 should be deleted;
Line 28, "polyester" should read --polyester.--

COLUMN 28
Line 40, "Bβ-1" should read --β-1--;
Line 58, "(vii)" should read --(vii)*--;
Line 59, "(viii)" should read --(viii)*--.

UNITED STATES PATENT AND TRADEMARK OFFICE

CERTIFICATE OF CORRECTION

PATENT NO. : 5,660,963

DATED : August 26, 1997

INVENTOR(S): TADASHI DOUJO ET AL.

It is certified that error appears in the above-identified patent and that said Letters Patent is hereby corrected as shown below:

COLUMN 29
Line 54, "acids" should read --acids β-1,--.

COLUMN 30
Line 55, "weight" should read --weight---;
Line 58, "$m_2$" should read --$m^2$--;
Line 63, "respect" should read --respect to--.

COLUMN 31
Line 3, "evaluation" should read --evaluation,--;
Line 35, "scale)." should read --scale)--.

COLUMN 32
Line 45, "cylinder" should read --cylinder is--.

COLUMN 33
Line 28, "an" should read --and--.

COLUMN 34
Line 10, "10)." should read --(10)--;
Line 10, "(Tos)." should read --(Tos)--;
Line 21, "190°C. Tos" should read --190°C.≦ Tos--;
Line 26, "100 ml-" should read --100-ml--;
Table 4, Example 9, "3" should read --22--.

UNITED STATES PATENT AND TRADEMARK OFFICE

CERTIFICATE OF CORRECTION

PATENT NO. : 5,660,963

DATED : August 26, 1997

INVENTOR(S): TADASHI DOUJO ET AL.

It is certified that error appears in the above-identified patent and that said Letters Patent is hereby corrected as shown below:

COLUMN 36

Table 6, Example 15, "6.9" should read --6.7--.

COLUMN 37

Table 6, Heading,

" Anti-offset block " should read --Anti offset Anti block--.

COLUMN 39

Table 8, line 40, "Example" should read --Comparative Example --.

COLUMN 41

Table 9, Heading,

" Anti-offset block " should read --Anti offset Anti block--;

Example 3, "133 °C" should read --130 °C--;

Comparative Example 6, under column heading Initial Dmax , "Δx" should read --Δx 1.19--.

UNITED STATES PATENT AND TRADEMARK OFFICE

CERTIFICATE OF CORRECTION

PATENT NO. : 5,660,963

DATED : August 26, 1997

INVENTOR(S): TADASHI DOUJO ET AL.

It is certified that error appears in the above-identified patent and that said Letters Patent is hereby corrected as shown below:

COLUMN 41 (cont'd)

Table, 9, Comparative Example 6, under column heading $\frac{\text{After } 2 \times 10^4 \text{ sheets}}{\text{Dmax}}$, "Δx" should read --$\overset{\Delta x}{1.28}$--;

Comparative Example 6, under column heading $\frac{\text{50 mm/sec}}{\text{Solid black, (Dmax)}}$ $T_{F1}$ "Δx" should read --$\overset{\Delta x}{175}$ °C--;

Comparative Example 6, under column heading $\frac{\text{500 mm/sec}}{\text{Solid black, (Dmax)}}$ $T_{F1}$ "x" should read --$\overset{x}{200}$ °C--.

COLUMN 43

Line 65, "α10" should read --α-10--;

Line 66, "acid" should read --acid β-1--.

COLUMN 45

Line 60, "respect" should read --respect to--.

UNITED STATES PATENT AND TRADEMARK OFFICE

CERTIFICATE OF CORRECTION

PATENT NO. : 5,660,963

DATED : August 26, 1997

INVENTOR(S): TADASHI DOUJO ET AL.

It is certified that error appears in the above-identified patent and that said Letters Patent is hereby corrected as shown below:

COLUMN 46
Line 8, "prepared" should read --prepared and evaluated--;
Line 8, delete "in the same d".

COLUMN 48
Line 48, "contain" should read --contains--;
Line 65, "contain" should read --contains--.

COLUMN 49
Line 12, "claim 23," should read --claim 22,--.

COLUMN 50
Line 7, "weight average" should read --weight-average--;
Line 20, "contain" should read --contains--.

Signed and Sealed this

Thirty-first Day of March, 1998

*Attest:*

*Attesting Officer*

BRUCE LEHMAN

*Commissioner of Patents and Trademarks*